US007992712B2

(12) United States Patent
Rosland

(10) Patent No.: US 7,992,712 B2
(45) Date of Patent: Aug. 9, 2011

(54) BED SHEET STORAGE DEVICE

(76) Inventor: Linsey Rosland, Clarendon, IL (US)

( * ) Notice: Subject to any disclaimer, the term of this patent is extended or adjusted under 35 U.S.C. 154(b) by 385 days.

(21) Appl. No.: 11/483,967

(22) Filed: Jul. 11, 2006

(65) Prior Publication Data

US 2010/0213094 A1 Aug. 26, 2010

(51) Int. Cl.
*B65D 85/48* (2006.01)
*A41H 33/00* (2006.01)

(52) U.S. Cl. ..... 206/449; 206/278; 223/37; 229/87.01

(58) Field of Classification Search ..... 206/449, 206/455, 494, 495, 525.1, 278; 223/37, 38, 223/87; 229/87.01–87.06, 87.15–87.17, 229/87.07–87.13; 493/405, 478
See application file for complete search history.

(56) References Cited

U.S. PATENT DOCUMENTS 1,352,962 A * 9/1920 Hitzigrath ..... 206/525.1
1,780,135 A * 10/1930 Lee ..... 229/87.06
1,953,887 A * 4/1934 Medoff ..... 206/494
1,967,584 A * 7/1934 McKenna ..... 206/278
2,283,949 A * 5/1942 Ringler ..... 206/449
3,035,756 A * 5/1962 Mullinix ..... 229/87.11
3,054,681 A * 9/1962 Nelson et al. ..... 229/87.11
3,346,104 A * 10/1967 Marsh ..... 206/525.1
3,749,301 A * 7/1973 Peckar ..... 229/125.37
3,970,226 A 7/1976 Lanagan et al.
4,295,565 A * 10/1981 Takeuchi ..... 206/455
5,417,641 A * 5/1995 Warren ..... 493/405
5,816,434 A * 10/1998 Weinstein ..... 223/37
6,360,927 B1 * 3/2002 Barker ..... 223/37
6,814,269 B1 * 11/2004 Fernandez ..... 223/37
2008/0264983 A1 * 10/2008 Kastan ..... 223/38

* cited by examiner

*Primary Examiner* — Bryon P Gehman
(74) *Attorney, Agent, or Firm* — McDonnell Boehnen Hulbert & Berghoff LLP

(57) ABSTRACT

A bed sheet storage device for compactly folding and storing a bed sheet set between uses. The storage device includes a foldable rectangular panel assembly with a center panel disposed between a pair of side panels hingedly connected together edgewise using living hinges, separate hinges, elastic strips, or intermediate panels hingedly connected edgewise thereto. A pair of semi-circular corner retaining panels may be hingedly connected edgewise to the side panels to retain two corners of the fitted sheet. The panel assembly has a flat opened position and a closed position which defines an enclosed channel therethrough to contain excess sheet material of a fitted sheet, a folded flat sheet, and two folded pillow covers of the bed sheet set. Sheet retaining devices include a non-skid pad, spring clips, spring boxes, and elastic retaining strips to retain the fitted sheet tautly folded around the panel assembly. Panel retaining devices include pairs of mutually-attracting magnets, locking hinges, spring clips, and elastic retaining bands to retain the panel assembly in the folded position.

19 Claims, 11 Drawing Sheets

BED SHEET STORAGE DEVICE

BACKGROUND OF THE INVENTION

1. Field

Figure 1:
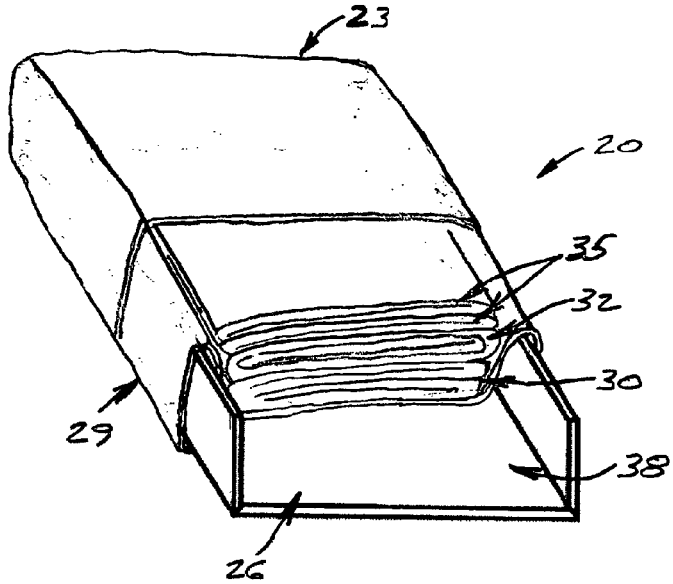
FIG. 1 (Prior Art)

The present invention relates generally to sheet folding devices and methods, and more specifically to those which are used both for folding and storing sheets and other bedding.

2. State of the Art

Bed sheet sets typically include a fitted sheet having a plurality of elasticized corners, a flat sheet, and a pair of pillow covers that are initially packaged together within a plastic bag and supported by a cardboard insert. This packaging allows the bed sheet set to be nicely presented on store shelves and shipping in a compact, stackable rectangular configuration. Problems begin once the bed sheet set is unpackaged, used on a bed mattress and pillows, washed, and is ready for storage prior to next use. Neatly folding of fitted sheets for storage is particularly troublesome due to the elasticized corners which inwardly draw the fitted sheet to a non-planar shape. The elasticized corners function to retain the fit the corners to respective corners of a bed mattress to secure the fitted sheet in place thereon. Likewise, the folded fitted sheet, flat sheet, and pillow covers are typically stacked in a drawer which is not a particularly desirable way to store them.

Folding of flat sheets is typically conducted by two persons who grasp adjacent edges of the flat sheet in respective hands and approach one another with raised hands. A mid-section of the sheet falls into a loop and forms a fold between the persons. One person then grasps corresponding adjacent corners of the flat sheet and the other person grasps adjacent edges of the sheet at the fold and the steps are repeated until a desired number of primary folds are made. The folded flat sheet is then rotated ninety degrees in its own plane and then the steps are repeated to produce a plurality of secondary folds. Folding of the folded flat sheet now significantly reduced in size may be completed by one person. Fitted sheets may be folded in a similar manner with significantly worse results due to inward pulling of the elasticized corners. Folding of the pillow covers is easily done by one person due to the small size thereof.

Various devices have been patented in attempts to solve the problem of folding fitted and flat sheets, particularly without requiring two persons. For example, in U.S. Pat. No. 5,816,434 issued to Weinstein on Oct. 6, 1998 is disclosed a sheet folding device for assisting a single user to fold fitted and flat bed sheets, bed spreads, and table cloths. The device includes a spring clip and a right angle hook with an elastomeric sleeve about which folds are made, both affixed to a mounting plate. The mounting plate is screw-mounted to a wall, a mobile cart, or other vertical surface above a floor to accommodate sheets and the like of differing sizes. The device is used to fold a sheets by connecting a corner of the sheet to the spring clip. The hook is used to fold the sheet without touching the floor.

While the apparatus of Weinstein is generally satisfactory for the purposes intended, it has some serious shortcomings. Firstly, the device does not have provisions for storing the folded sheets. Secondly, the apparatus is affixed to the wall using screws which is semi-permanent mounting that damages the wall.

In U.S. Pat. No. 3,970,226 issued to Lanagan, et al. on Jul. 20, 1976 is disclosed an apparatus and method for holding one end of a sheet to be folded. The apparatus includes a top bar pivotably mounted to the frame, a bottom bar fixedly mounted to a frame, each mounted atop a table. The apparatus is used by extending an end portion of the sheet over the top bar, downwardly between both bars, and pulling horizontally away from the top bar to a taut condition. This forces the end portion of the sheet against the bottom bar forcing the bars together to grip the end portion therebetween. The sheet is released by pulling it downwardly. The table supports the sheet as the end portion of the sheet is extended between the bars.

While the apparatus of Lanagan is generally satisfactory for the purposes intended, it has some serious shortcomings. Firstly, the apparatus cannot be used to fold fitted sheets due to the elasticized corners. Secondly, the apparatus does not have provisions for storing the folded sheets. Thirdly, the apparatus is rather large, heavy, and bulky by including the table on which users fold the sheets.

There is a need for a sheet folding and storage device that solves the above-enumerated shortcomings of the prior art devices including: 1) allows folding of fitted sheets with the elasticized corners; 2) has provisions for storing the folded sheets; 3) is not large or heavy; and 4) not requiring affixing to walls or other vertical surface with resulting damage thereto.

Additionally, the sheet folding and storage device should: 5) enable a single user to quickly and easily fold fitted and flat sheets with clean edges for aesthetically pleasing storage; 6) fold fitted and flat sheets used for different sized beds without necessitating adjustments; 7) not require any special skills or training to operate; and 8) be of a light-weight, durable, simple design.

SUMMARY OF THE INVENTION

The present invention is a bed sheet storage device and method for neatly compactly folding and storing a fitted sheet with four elasticized corners, a flat sheet, and a pair of pillow covers of a bed sheet set between uses.

The bed sheet storage device includes a foldable panel assembly comprised of a plurality of rectangularly shaped panels hingedly connected together edgewise. The panels include a center panel disposed between a pair of side panels which form respective outer and inner surfaces thereof. The panel assembly has a flat opened position and a closed position wherein the inner surface defines an enclosed channel therethrough. One or more sheet retaining devices are adapted to retain the fitted sheet tautly folded around the outer surface of the panel assembly. The storage device is used by placing the outer surface of the panel assembly in the opened position on the fitted sheet unfolded on a support surface. The fitted sheet is folded over the panel assembly and secured tautly folded therearound in a single layer covering the outer surface using each sheet retaining device. Excess sheet material is bunched up and placed on the inner surface along with the flat sheet and the pillow covers folded thereon. The panel assembly is folded to the closed position to form the channel containing the excess sheet material, the flat sheet, and the pillow covers for storage.

A preferred bed sheet storage device includes a panel assembly retaining device adapted to retain the panel assembly in the closed position during storage.

The panel assembly of the preferred bed sheet storage device includes one or more feature of: 1) the side panels being elastically connected to the center panel using respective elastic strips affixed thereto adapted to stretch to accommodate and further retain the bunches, the flat sheet, and the pillow covers within the channel formed by the panel assembly; 2) the panel assembly including a pair of intermediate panels hingedly connected edgewise to respective of the center panel and the side panels; 3) the panel assembly including a pair of foldable corner retaining panels each of semi-circular shape hingedly connected edgewise to respective of the side panels adapted to retain adjacent of the elasticized corners of the fitted sheet to the panel assembly; 4) the panel assembly being of a unitary design made of a single sheet of plastic material with the panels connected together using respective living hinges that are heat-formed; 5) the center and side panels being connected together using pairs of separate hinges affixed thereto; and 6) the side panels being narrower than the center panel to form a center gap therebetween.

Each sheet retaining device of the preferred bed sheet storage device may be of several types. A first type of sheet retaining device is a resilient non-skid pad affixed to at least one of the center and side panels adapted to retain the fitted sheet in place thereagainst.

A second type of sheet retaining device are a pair of spring clips operatively associated with respective of the side panels. Each spring clip is disposed in a position adjacent a side edge of the side panel in a relationship thereto of parallel or perpendicular. Each spring clip includes a spring adapted to bias together a gripping surface of at least one movable gripping arm and another gripping surface thereof from an opened non-gripping position to a gripping position to retain the fitted sheet to respective of the side panels. The gripping arm includes a body having one of the gripping surfaces and a thumb grip centrally disposed along the body extending perpendicularly therefrom to facilitate opening of the spring clip.

A third type of sheet retaining device are four hollowed spring boxes disposed at respective corners of the panel assembly each having a base wall affixed to respective of the side panels, a peripheral wall, and a top wall. The top wall has a retaining opening with a plurality of inwardly-directed retaining tabs adapted to deflect inwardly upon application of finger pressure on the fitted sheet to an opened non-gripping position. The retaining tabs rebound outwardly upon release of the finger pressure to a gripping position to retain the fitted sheet to the side panels.

A third type of sheet retaining device are a pair of elastic retaining strips affixed at opposite ends thereof flat against respective of the side panels. The retaining strips are adapted to stretch to retain the fitted sheet to respective of the side panels.

The spring clips are each of a main type of: 1) detachable from the panel assembly each comprising a pair of the gripping arms centrally interconnected by the spring with the gripping surface thereof being of a length sufficient to grip at least half of respective of the side edges with the fitted sheet therebetween; or 2) affixed to the panel assembly each comprising a base affixed to respective of the side panels disposed within the channel of the panel assembly in the closed position having one of the gripping surfaces and at least one gripping arm pivotally connected thereto interconnected by the spring to grip the fitted sheet therebetween, each gripping arm including a body having one of the gripping surfaces and a thumb grip centrally disposed along the body extending perpendicularly therefrom to facilitate opening of the spring clip.

The spring clips may be of several different sub-types. A first sub-type of spring clip includes a spring tube enclosing a torsion spring for each gripping arm affixed to the base and a pair of resilient retaining tubes. Each gripping arm is made of bent wire having the thumb grip of an upwardly curved semi-circular shape. A pair of laterally dependent gripping portions are adapted to grip the fitted sheet against the base. A pair of laterally dependent pivot arms that pivotally engage opposite ends of the spring tube are biased by the torsion spring. The retaining tubes are fitted over the gripping portions of each gripping arm adapted to frictionally engage the fitted sheet.

A second sub-type of spring clip includes a pair of the gripping arms oppositely pivotally connected to the base biased by a pair of the springs. The gripping arms are integrally molded with the base and hingedly connected thereto at respective living hinges.

A third sub-type of spring clip includes a pair of the gripping arms interconnected by a base arm. The gripping arms are slightly convergent towards one another and the base arm is slightly longer than the side panels are thick. The gripping arms and the base function as a spring to bias together a pair of gripping surfaces thereof from an opened non-gripping position to a gripping position to retain the fitted sheet to respective of the side panels.

Each spring box may be of a six-sided box design with the peripheral wall comprising four side walls which along with the base wall and the top wall are all of rectangular shape. The top wall has a plurality of radial slits that define the retaining tabs each of triangular shape. The retaining tabs have respective locking tips adapted to grip the fitted sheet.

Each panel assembly retaining device of the preferred bed sheet storage device may be of several types. A first type of panel assembly retaining device are two pairs of mutually-attracting magnets respectively affixed to one of the side panels adjacent the side edge and to the center panel in a mating orientation to retain the panel assembly in the closed position.

A second type of panel assembly retaining device are a plurality of pairs of separate locking hinges each including a pair of mounting plates affixed to respective of the center and side panels. The mounting plates are interconnected by a pivoting locking mechanism to connected them together. The locking mechanism is adapted to retain the panel assembly in the closed position when the mounting plates are pivoted to a generally parallel position.

A third type of panel assembly retaining device are a pair of spring clips operatively associated with the center panel and respective of the side panels. Each spring clip includes a pair of gripping arms interconnected by a base arm. The gripping arms are slightly convergent towards one another and the base arm is slightly longer than the panel assembly in the closed position is thick. The gripping arms and the base arm function as a spring to bias together a pair of gripping surfaces thereof from an opened non-gripping position to a gripping position to retain the panel assembly in the closed position.

A fourth type of panel assembly retaining device is a spring clip operatively associated with respective of the side panels. The spring clip includes two oppositely facing pairs of gripping arms interconnected by respective base arms and a middle arm that interconnects the base arms. The gripping arms are slightly convergent towards one another and the base arm is slightly longer than the side panels are thick. The gripping arms and the base arm function as a spring to bias together a pair of gripping surfaces thereof from an opened non-gripping position to a gripping position to retain the fitted sheet to respective of the side panels and retain the panel assembly in the closed position.

A fifth type of panel assembly retaining device is an elastic retaining band adapted to stretch about and retain the panel assembly in the closed position.

The method comprises the steps of: 1) providing a bed sheet storage device that includes a foldable panel assembly comprised of a plurality of rectangularly shaped panels hingedly connected together edgewise including a center panel disposed between a pair of side panels which form respective outer and inner surfaces thereof, the panel assembly having a flat opened position and a closed position wherein the inner surface defines an enclosed channel therethrough and at least one sheet retaining device adapted to retain the fitted sheet tautly folded around the outer surface of the panel assembly; 2) placing an outer surface of the fitted sheet in an unfolded inverted position on a flat horizontal support surface; 3) placing the outer surface of the panel assembly in the opened position on an inner surface of the fitted sheet between the elasticized corners thereof; 4) folding the fitted sheet over the panel assembly; 5) securing the fitted sheet tautly folded around the panel assembly in a single layer covering the outer surface of the panel assembly using each sheet retaining device; 6) bunching up and placing excess sheet material on the inner surface of the panel assembly; 7) placing the flat sheet and the pillow covers on the excess sheet material; and 8) folding the panel assembly to the closed position to form the channel with the excess sheet material, the flat sheet, and the pillow covers disposed within the channel for storage.

A preferred method further comprises the steps of: 8) folding the flat sheet and the pillow covers prior to placing on the excess sheet material; 9) retaining the panel assembly in the closed position during storage using at least one panel assembly retaining device; and 10) opening the panel assembly to the opened position after storage using each panel assembly retaining device.

In the preferred method, the sheet retaining device of the bed sheet storage device provided is chosen from the group consisting of: 1) a resilient non-skid pad affixed to at least one of the center and side panels; 2) a pair of spring clips operatively associated with respective of the side panels; 3) a plurality of hollowed spring boxes affixed to respective of the side panels each having a plurality of resilient retaining tabs that deflect inwardly upon application of finger pressure on the fitted sheet; and 4) a pair of elastic retaining strips affixed at opposite ends thereof flat against respective of the side panels.

In the preferred method, the step of securing the fitted sheet around the panel assembly includes respective of: a) smoothing the fitted sheet against the non-skid pad; b) clipping the fitted sheet to the side panels; c) pushing the fitted sheet against the retaining tabs; and d) placing the fitted sheet between the elastic strips and respective of the side panels;

C) the bed sheet storage device provided includes the panel assembly retaining device;

D) each panel assembly retaining device is chosen from the group consisting of: 1) two pairs of mutually-attracting magnets respectively affixed to one of the side panels and to the center panel in a mating orientation; 2) a plurality of pairs of locking hinges affixed to respective of said center and side panels; 3) a pair of spring clips operatively associated with the center panel and respective of the side panels; 4) a spring clip operatively associated with respective of the side panels that also retains the fitted sheet to respective of the side panels; and 5) at least one elastic retaining band adapted to stretch about the panel assembly;

E) the step of retaining the panel assembly in the closed position for the pair and single spring clips includes respective of: a) clipping the panel assembly in the closed position; and b) clipping the fitted sheet to the side panels; and F) wherein the step of folding the fitted sheet over the panel assembly comprises inwardly folding the fitted sheet along respective imaginary longitudinal fold lines that extend from respective end edges of the panel assembly and inwardly folding the fitted sheet along respective imaginary lateral fold lines that extend from respective side edges of the panel assembly.

The panel assembly of the bed sheet storage device provided may be placed on the fitted sheet centered between the elasticized corners thereof.

Alternatively: 1) the panel assembly of the bed sheet storage device provided includes a pair of foldable corner retaining panels each of semi-circular shape hingedly connected edgewise to respective of the side panels at the lateral fold lines to retain adjacent of the elasticized corners of the fitted sheet to said panel assembly; 2) the panel assembly is placed on the fitted sheet offset between a pair of the elasticized corners; and 3) the step of folding the fitted sheet over the panel assembly includes moving the pair of the elasticized corners inwardly over the corner retaining panels and folding the corner retaining panels with the elasticized corners inwardly along the lateral fold lines.

THE DRAWINGS

Figure 2:
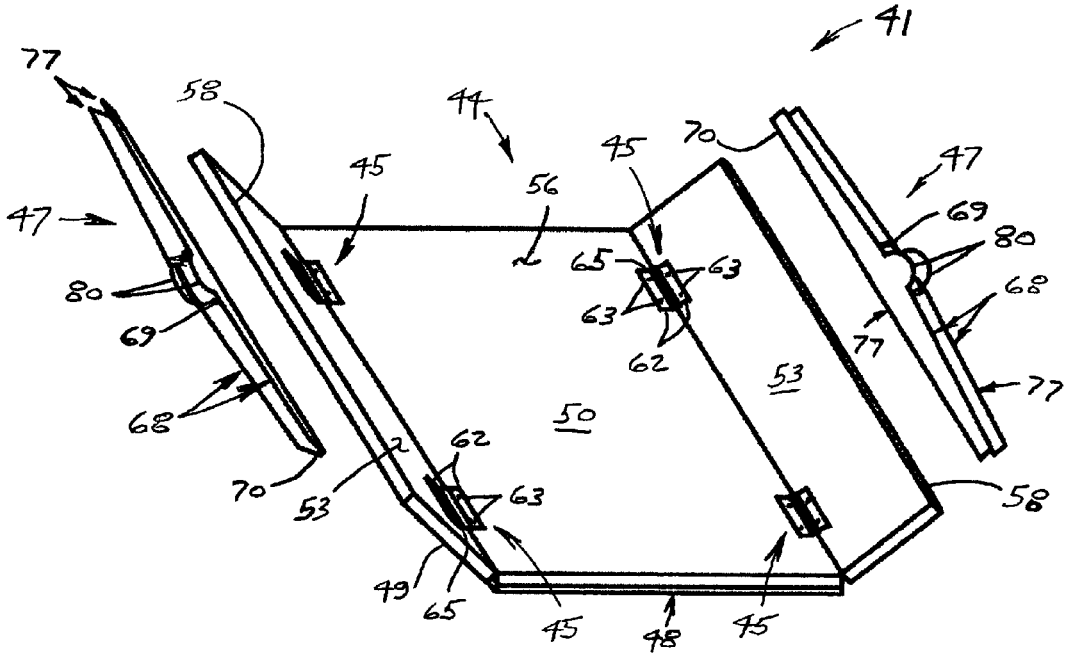
Figure 3:
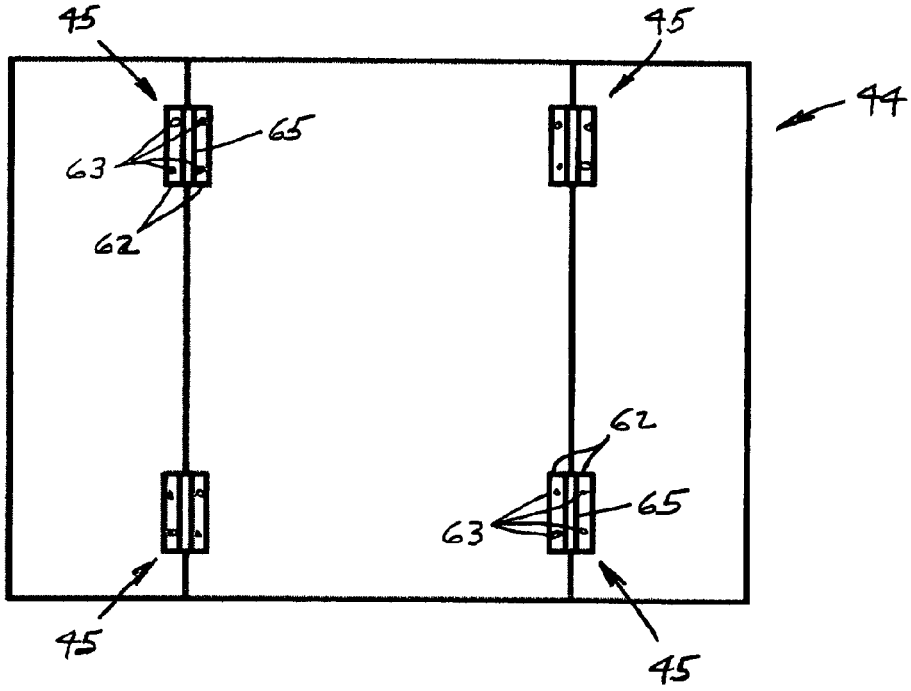
Figure 4:
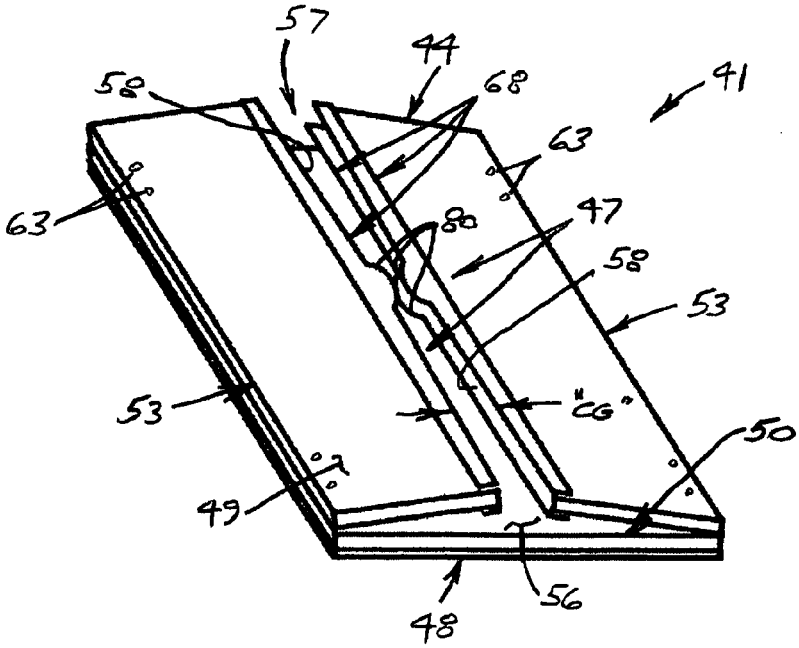
Figure 5:
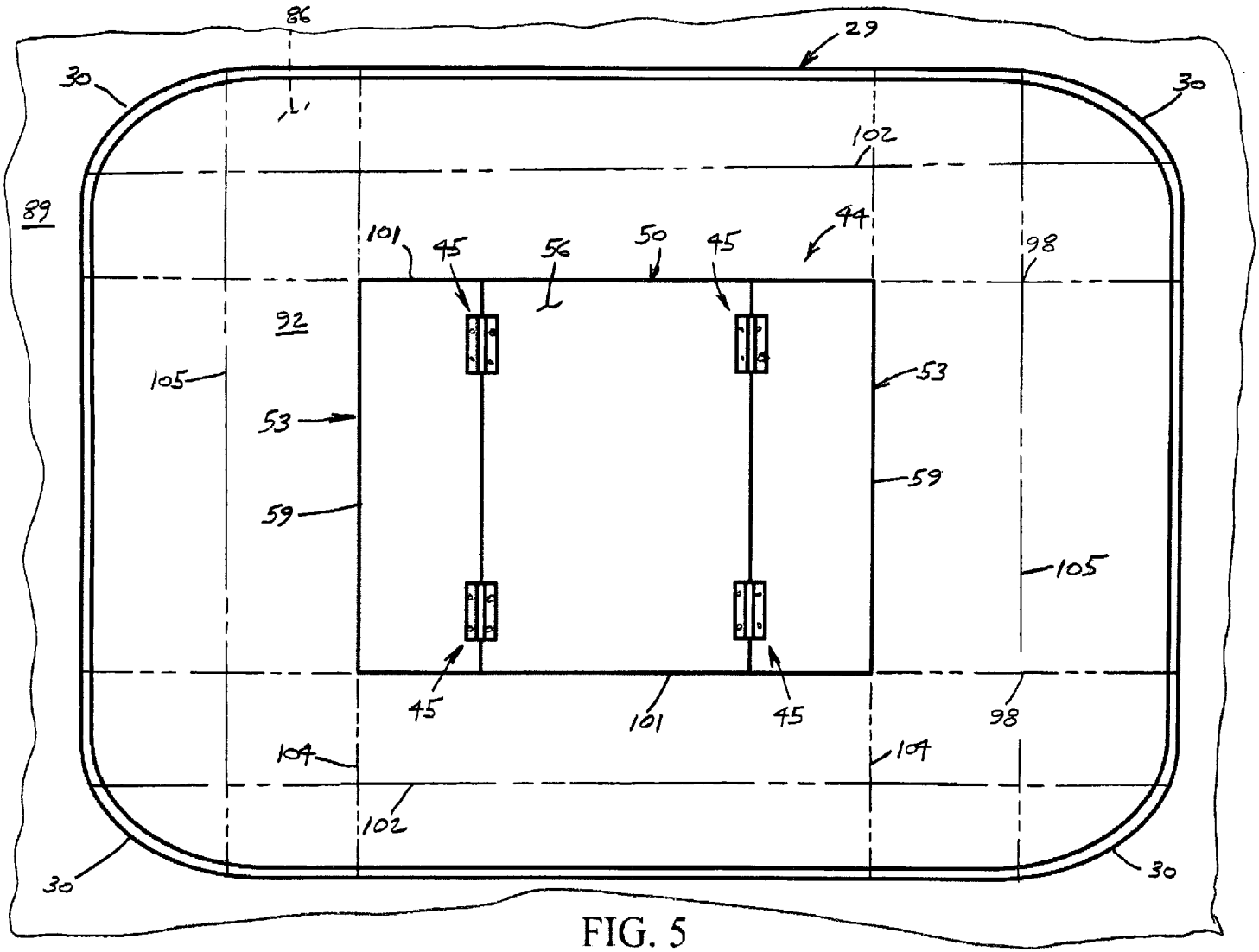
Figure 6:
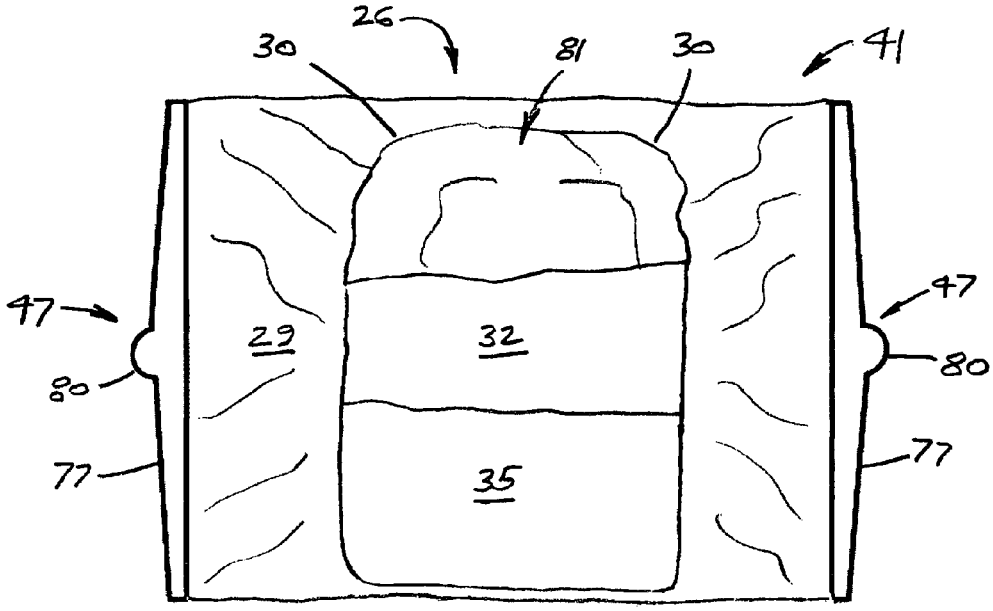
Figure 7:
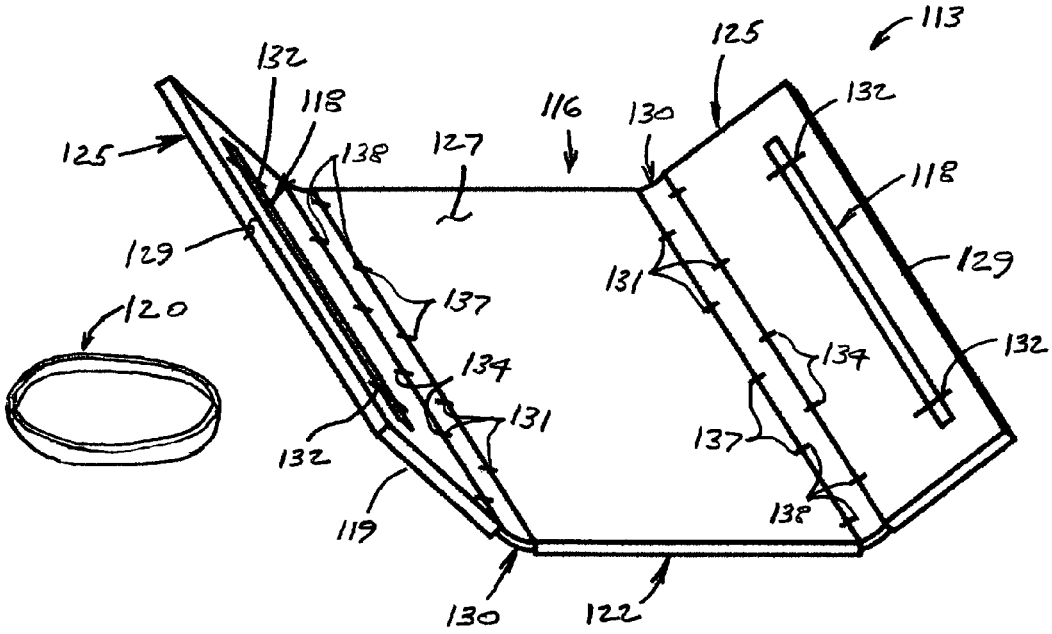
Figure 8:
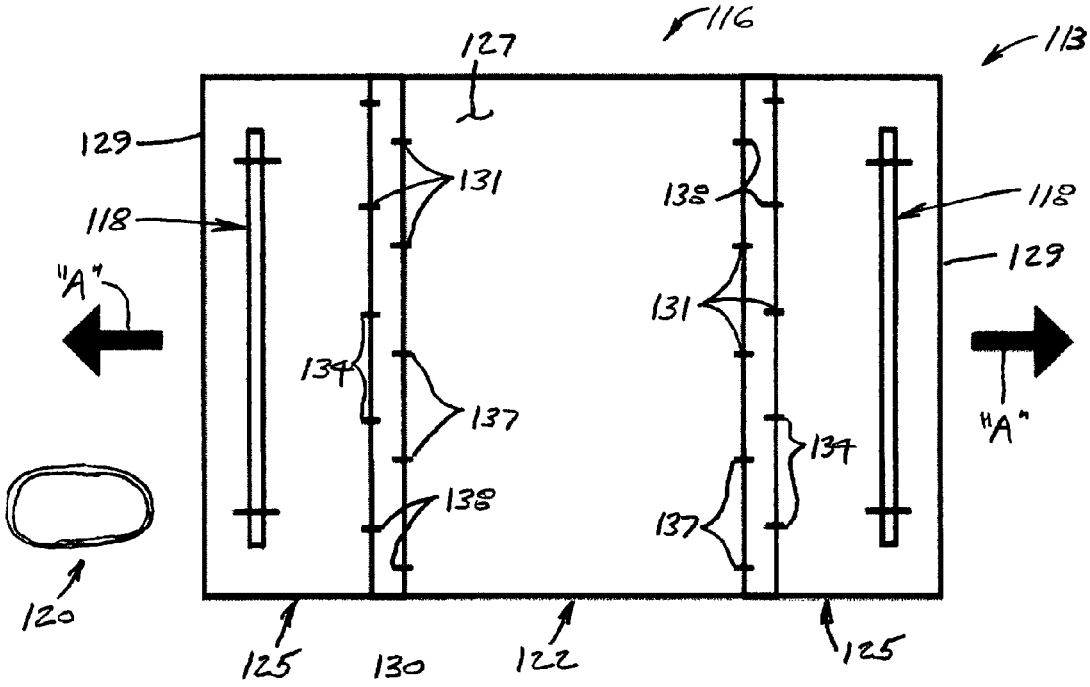
Figure 9:
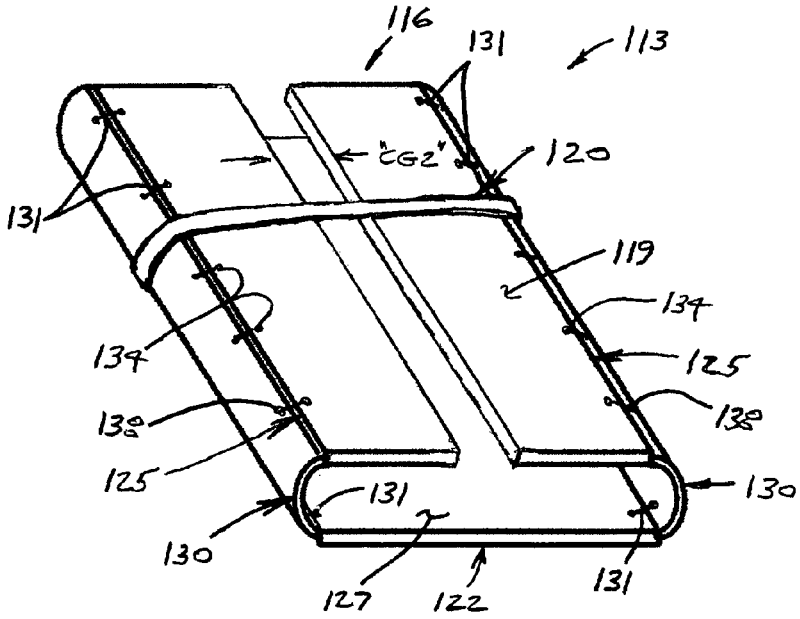
Figure 10:
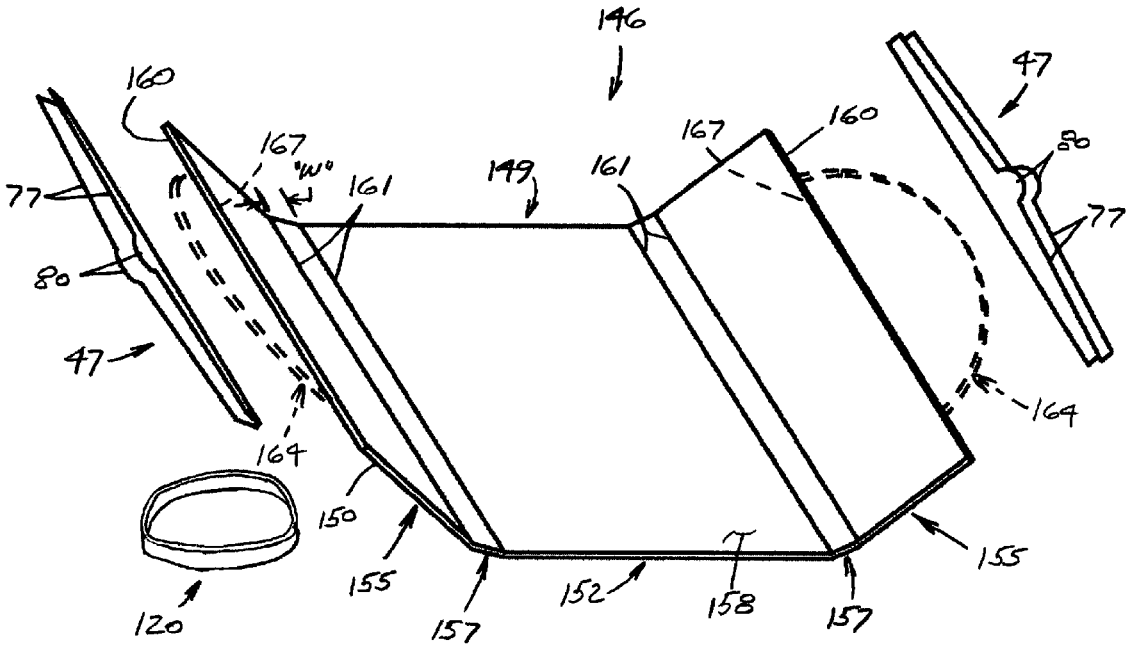
Figure 11:
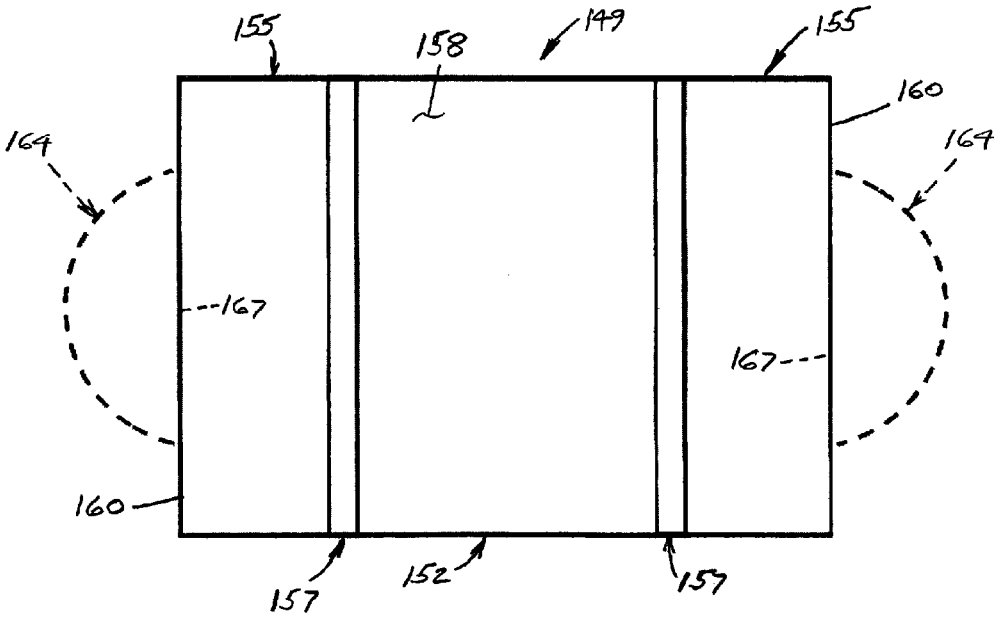
Figure 12:
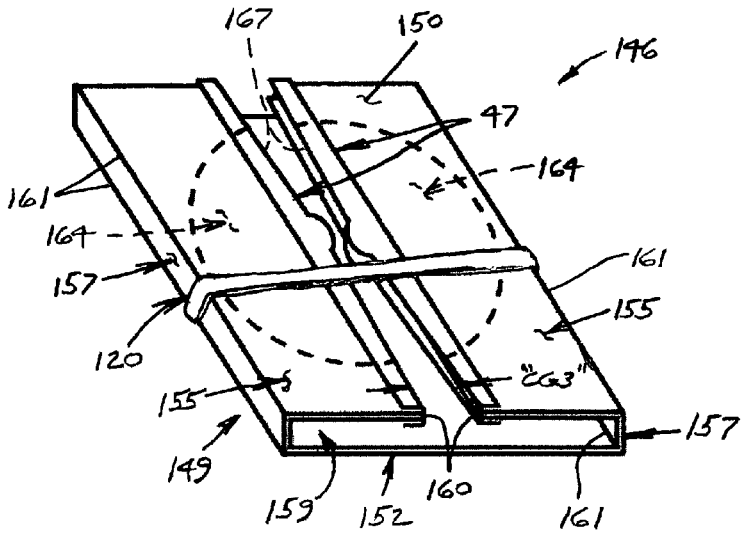
Figure 14:
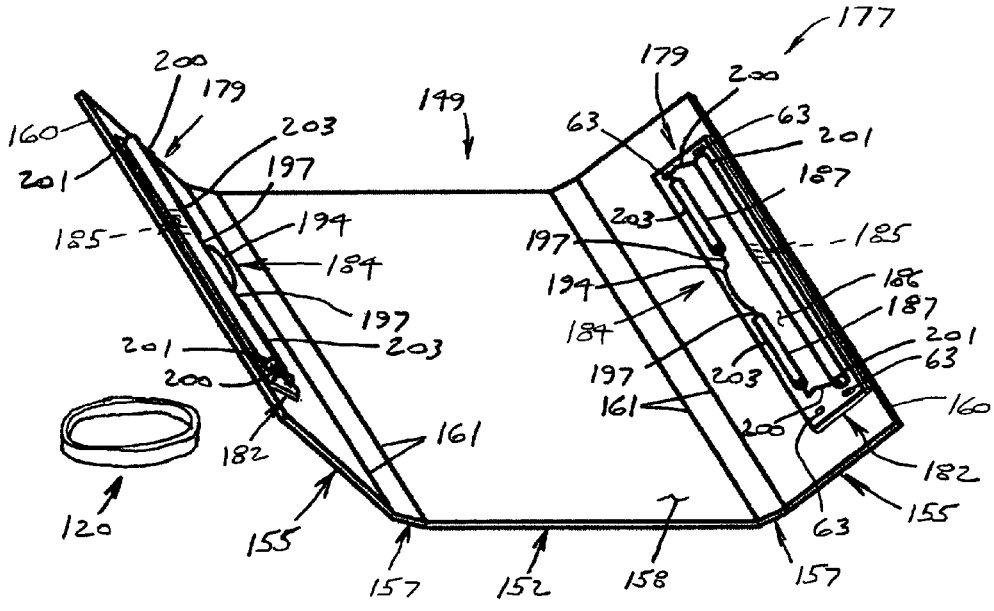
Figure 13:
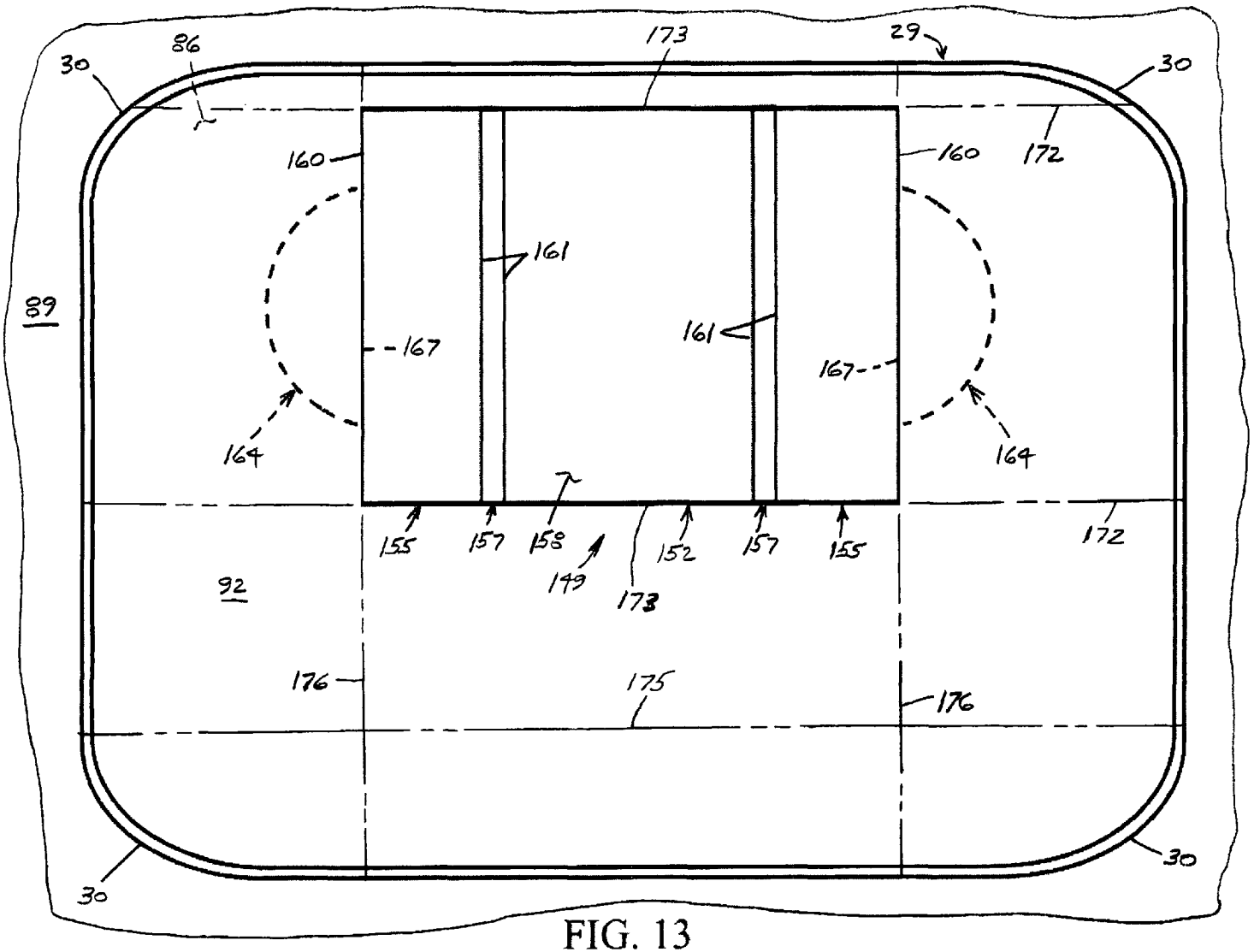
Figure 15:
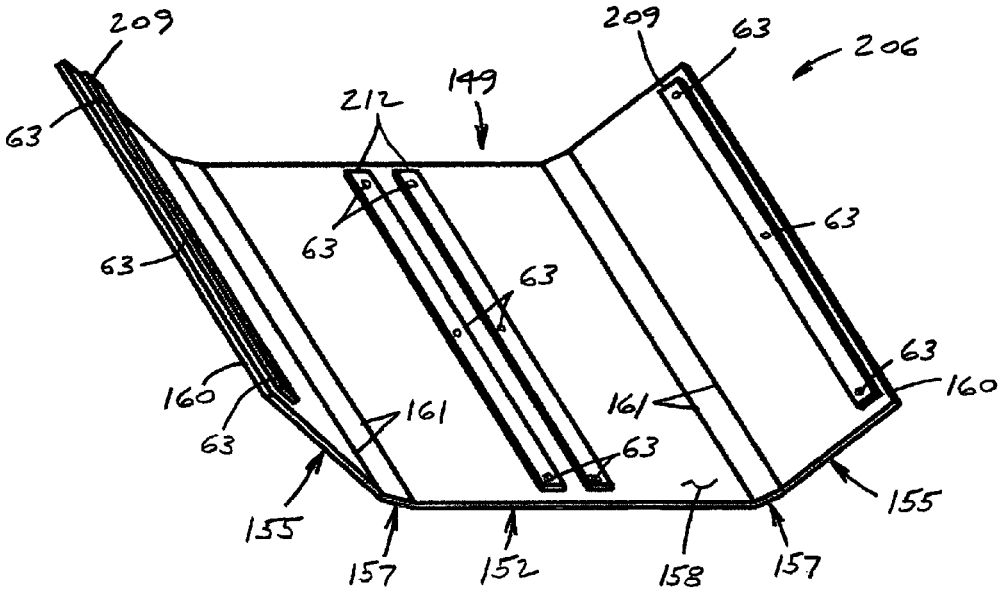
Figure 16:
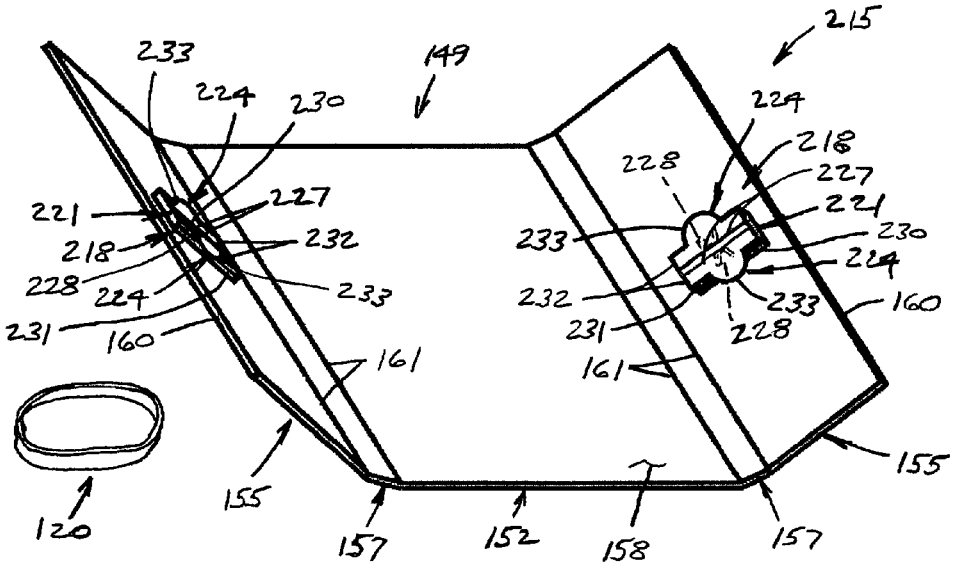
Figure 17:
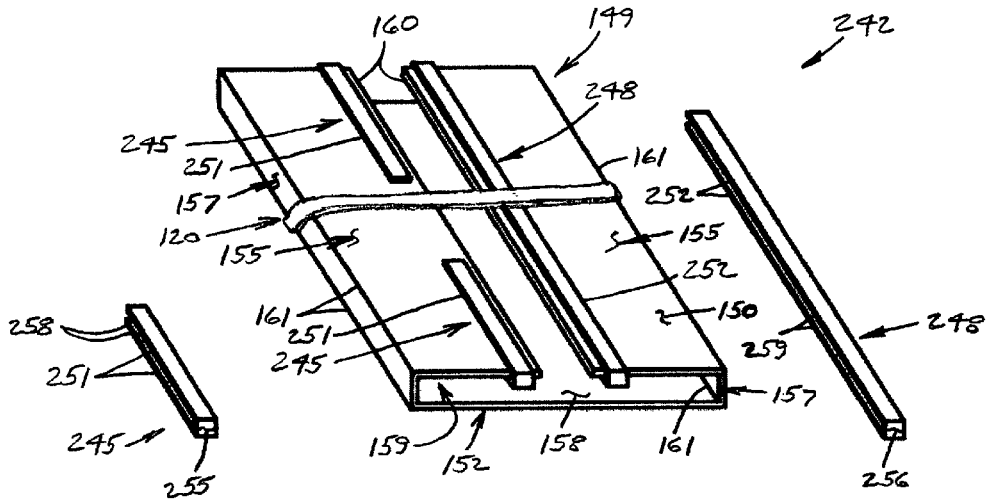
Figure 18:
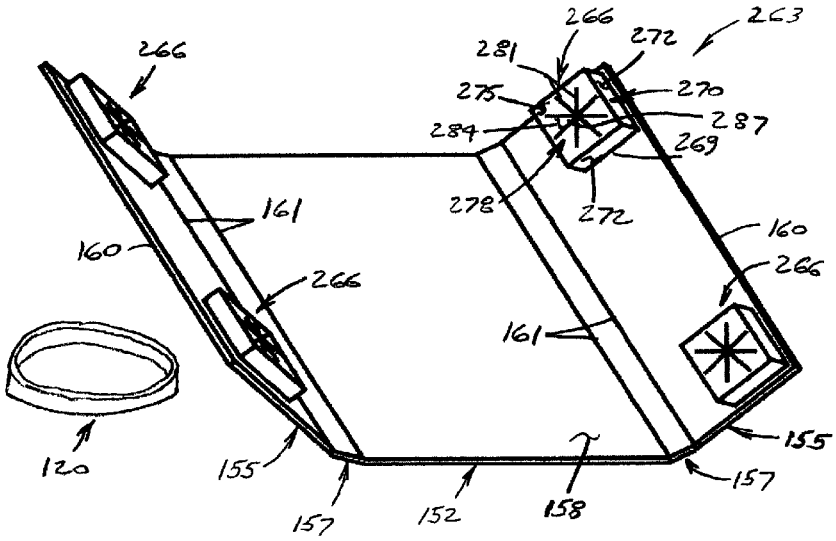
Figure 19:
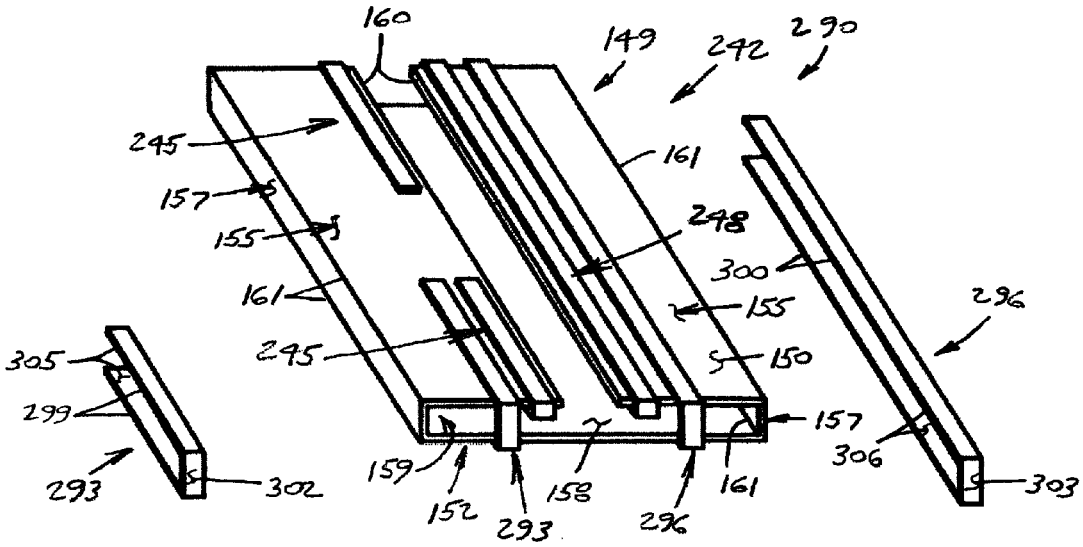
Figure 20:
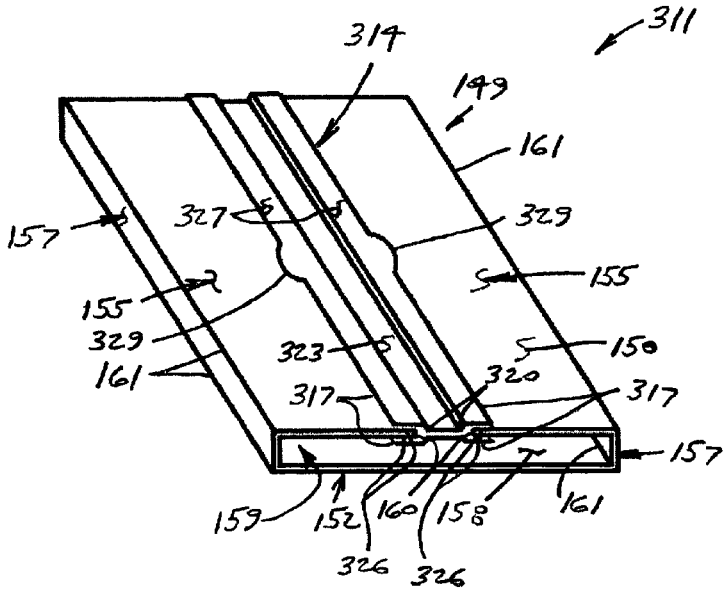

The best mode presently contemplated for carrying out the invention is illustrated in the accompanying drawings, in which:

FIG. 1 is a perspective view of a prior art U-shaped cardboard insert which along with a flexible plastic bag packages a conventional bed sheet set that includes a fitted bed sheet folded around the insert and a flat sheet with a pair of pillow covers folded and disposed within a U-shaped channel formed by the insert;

FIG. 2, a perspective view of a first embodiment bed sheet storage device of the present invention for neatly compactly folding and storing the bed sheet set following unpackaging between uses with a foldable first version panel assembly thereof shown in an opened position and a pair of first version spring clips disconnected therefrom;

FIG. 3, a top plan view of the panel assembly which includes a center panel with a pair of side panels pivotally connected thereto using respective pairs of locking hinges;

FIG. 4, a perspective view of the storage device with the hinges retaining the panel assembly in a closed position, the spring clips gripping respective outer edges of the side panels to retain the fitted bed sheet tautly folded therearound, and the flat sheet with the pillow covers folded and disposed within a V-shaped channel formed by the panel assembly;

FIG. 5, a top plan view of the panel assembly in the opened position disposed on an inner surface of the fitted bed sheet on a support surface centered between respective elasticized corners thereof prior to folding;

FIG. 6, a top plan view of the panel assembly with the fitted sheet folded thereabout and excess sheet material bunched up prior to connecting the spring clips to the outer edges of the side panels;

FIG. 7, a perspective view of a second embodiment bed sheet storage device with a foldable second version panel assembly thereof shown in the opened position and a pair of the first version spring clips disconnected therefrom;

FIG. 8, a top plan view of the panel assembly which includes a center panel with a pair of side panels elastically connected thereto using respective elastic strips;

FIG. 9, a perspective view of the storage device with a pair of elastic retaining bands retaining the panel assembly in the closed position, the spring clips gripping respective outer edges of the side panels to retain the fitted bed sheet tautly folded therearound, and the flat sheet with the pillow covers folded and disposed within a V-shaped channel formed by the panel assembly;

FIG. 10, a perspective view of a third embodiment bed sheet storage device with a foldable third version panel assembly thereof shown in the opened position and a pair of the first version spring clips disconnected therefrom;

FIG. 11, a top plan view of the panel assembly which includes a center panel, a pair of intermediate panels, a pair of side panels, and a pair of optional foldable semi-circular sheet corner retaining panels pivotally connected together using respective living hinges;

FIG. 12, a perspective view of the storage device with a pair of the retaining bands retaining the panel assembly in the closed position, the spring clips gripping respective outer edges of the side panels to retain the fitted bed sheet tautly folded therearound, and the flat sheet with the pillow covers folded and disposed within a rectangular-shaped channel formed by the panel assembly;

FIG. 13, a top plan view of the panel assembly in the opened position disposed on the bottom surface of the fitted bed sheet on the support surface offset between respective of the elasticized corners thereof prior to folding;

FIG. 14, a perspective view of a fourth embodiment bed sheet storage device with the third version panel assembly thereof shown in the opened position, a pair of second version spring clips affixed thereto to retain the fitted bed sheet tautly folded therearound, and a pair of the retaining bands for retaining the panel assembly in the closed position;

FIG. 15, a perspective view of a fifth embodiment bed sheet storage device with the third version panel assembly thereof shown in the opened position and two pairs of magnets affixed thereto to retain the panel assembly in the closed position;

FIG. 16, a perspective view of a sixth embodiment bed sheet storage device with the third version panel assembly thereof shown in the opened position, a third version spring clip affixed thereto to retain the fitted bed sheet tautly folded therearound, and a pair of the retaining bands for retaining the panel assembly in the closed position;

FIG. 17, a perspective view of a seventh embodiment bed sheet storage device with the third version panel assembly thereof shown in the opened position, a pair of fourth version spring clips and a fifth version spring clip connected thereto to retain the fitted bed sheet tautly folded therearound, and a pair of the retaining bands for retaining the panel assembly in the closed position;

FIG. 18, a perspective view of an eighth embodiment bed sheet storage device with the third version panel assembly thereof shown in the opened position, a plurality of sixth version spring clips affixed thereto to retain the fitted bed sheet tautly folded therearound, and a pair of the retaining bands for retaining the panel assembly in the closed position;

FIG. 19, a perspective view of a ninth embodiment bed sheet storage device with the third version panel assembly thereof shown in the opened position, a pair of the fourth version spring clips and the fifth version spring clip connected thereto to retain the fitted bed sheet tautly folded therearound, and a pair of sixth version spring clips and a seventh version spring clip connected thereto to retain the panel assembly in the closed position; and FIG. 20, a perspective view of a tenth embodiment bed sheet storage device with the third version panel assembly thereof shown in the opened position, an eighth version spring clip affixed thereto to retain the fitted bed sheet tautly folded therearound, and a pair of the retaining bands for retaining the panel assembly in the closed position.

DETAILED DESCRIPTION OF THE ILLUSTRATED EMBODIMENTS

Referring to FIG. 1, therein is shown a prior art U-shaped cardboard insert 20 which along with a flexible plastic bag 23 packages a conventional bed sheet set 26. The bed sheet set 26 includes a fitted sheet 29 with four elasticized corners 30 shown folded around the insert 20, a flat sheet 32, and a pair of pillow covers 35 folded and disposed within a U-shaped channel 38 formed by the insert 20. The insert 20 is typically made of a single folded piece of corrugated cardboard.

Referring to FIGS. 2-6, therein is shown a first embodiment bed sheet storage device 41 in accordance with the present invention for neatly compactly folding and storing the bed sheet set 26 between uses. The storage device 41 includes a foldable first version panel assembly 44, panel assembly retaining devices in the form of respective pairs of separate conventional locking hinges 45 adapted to retain the panel assembly 44 in a closed position during storage, and sheet retaining devices in the form of first version spring clips 47 and a resilient non-skid pad 48 adapted to retain the fitted sheet 29 tautly folded around an outer surface of 49 of the panel assembly 44.

The first version panel assembly 44 comprises a plurality of rectangularly shaped panels hingedly connected together edgewise including a center panel 50 disposed between a pair of side panels 53 which form respective outer and inner surfaces 49 and 56 thereof. The panel assembly 44 has a flat unfolded or opened position and a closed position wherein the inner surface 56 defines an enclosed V-shaped channel 57 therethrough. The center panel 50 is of a width and a length of about 8½ by 14 inches similarly to a sheet of legal size writing paper and the side panels 53 are narrower than the center panel 50 to form a center gap "CG" therebetween to accommodate the fitted sheet 29 and the spring clips 47. The panel assembly 44 has respective side edges 59 that are gripped by the spring clips 47. The center panel 50 and side panels 53 are made of a sheet material such as corrugated plastic, vinyl covered cardboard, solid plastic, or other suitable sheet material preferably of a thickness of between about 1/32 to ¼ inch thick.

The side panels 53 are hingedly connected to the center panel 50 using respective pairs of the locking hinges 45 each of which includes a pair of mounting plates 62 affixed to respective of the center panel 50 and the side panels 53 using materials such as rivets 63, staples (not shown), or an adhesive. The mounting plates 62 are interconnected by a pivoting locking mechanism 65 adapted to retain the panel assembly 44 in the closed position when the mounting plates 62 are pivoted to a generally parallel position as shown in FIG. 4 to retain the fitted sheet 29, the flat sheet 32, and the pillow covers 35 within the channel 57 formed by the panel assembly 44. The hinges 45 may be molded in one piece from a plastic material such as polyethylene, polypropylene, or polyvinyl chloride similarly to some locking caps of household products. Alternatively, the hinges 45 may be fabricated from suitable metal or plastic materials.

The panel assembly 44, as well as those that follow, are sized to accommodate fitted sheets 29 of different sizes. These include the standard sizes respectively of fitted and flat sheets: 1) crib 28×52 and 42×72 inches; 2) twin 39×75 and 66×96 inches; 3) twin x-long 39×80 and 66×102; 4) double/full 54×75 and 81×96 inches; 5) queen 60×80 and 90×102 inches; and 6) king 76×80 and 108×102 inches; 7) cal. king 72×84 and 102×110 inches. The panel assembly 44 may include additional side panels 53 or other panels (not shown) that can be incrementally folded out in the open position to accommodate larger sizes of the fitted sheets 29. Instructions on how to use the storage device 41 for different sized fitted sheets 29 may be printed on the panel assembly 44.

The first version spring clips 47 are of a design similar to "chip clips" used to seal opened bags of potato chips and similarly packaged food items but of a wider, lower profile design that are detachable from the panel assembly 44. The spring clips 47 are operatively associated with respective of the side panels 53 disposed in a position adjacent a one of the side edges 58 in a parallel relationship thereto.

Each spring clip 47 comprises a pair of movable gripping arms 68 centrally interconnected by a wire spring 69 adapted to bias together a pair of gripping surfaces 70 thereof from an opened non-gripping position to a gripping position to grip respective of the side edges 59 of the panel assembly 44 with the fitted sheet 29 therebetween to retain the fitted sheet 29 to respective of the side panels 53.

Each gripping arm 71 includes an elongated body 77 that is oppositely laterally tapered having one of the gripping surfaces 70 and a semi-circular thumb grip 80 centrally disposed along the body 77 extending perpendicularly therefrom to facilitate opening of the spring clip 47. The gripping surfaces 70 are each of a length sufficient to grip at least half of the side edge 59 and preferably extend substantially completely thereacross.

The non-skid pad 48 is affixed to the center panel 50 using an adhesive and is adapted to retain the fitted sheet 29 in place thereagainst. The non-skid pad 48 in made of a high friction, semi-tacky material that retains the fitted sheet 29 in place such as rubber of a thickness of between about 1/32 to 1/4 inch thick.

As best shown in FIGS. 4-6, the storage device 41 is used to store the bed sheet set 26 by placing an outer surface 86 of the fitted sheet 29 in a flattened inverted position on a flat horizontal support surface 89. The outer surface 49 of the panel assembly 44 disposed in the opened position is placed on an inner surface 92 of the fitted sheet 29 centered between respective of the elasticized corners 30 thereof. The fitted sheet 29 is inwardly folded along respective imaginary longitudinal fold lines 98 that extend from respective end edges 101 of the panel assembly 44. If so desired, the fitted sheet 29 may be initially folded along another imaginary longitudinal fold line 102 prior thereto to accommodate larger sizes of fitted sheets 29. The fitted sheet 29 is then inwardly folded along respective imaginary lateral fold lines 104 that extend from respective of the side edges 59 of the panel assembly 44. If so desired, the fitted sheet 29 may be initially folded along another imaginary lateral fold line 105 prior thereto to accommodate the larger sizes of fitted sheets 29.

The fitted sheet 29 is secured tautly folded around the panel assembly 44 in a single layer covering the outer surface 49 using the spring clips 47. The spring clips 47 are applied to the panel assembly 44 by squeezing together the thumb grips 71 thereof, positioning the gripping surfaces 83 about the side edges 59, and releasing the thumb grips 71 to retain the fitted sheet 29 tautly folded around the panel assembly 44. Any wrinkles of the fitted sheet 29 on the non-skid pad 54 may be hand-smoothed. The non-skid pad 54 may be used without the spring clips 47 if so desired. Excess sheet material 81 of the fitted sheet 29 including the elasticized corners 30 is bunched up and placed on the inner surface 56 of the panel assembly 44 along with the flat sheet 32 and the pillow covers 35 folded thereon.

The panel assembly 44 is folded to the closed position to form the channel 57 containing the excess sheet material 81, the flat sheet 32, and the pillow covers 35 for storage. The hinges 56 retain the panel assembly 44 in the closed position until sufficient opening force is applied. The procedure is reversed to remove the bed sheet set 26 from the storage device 41.

Referring to FIGS. 7-9, therein is shown a second embodiment bed sheet storage device 113 for neatly compactly folding and storing the bed sheet set 26 between uses. The storage device 113 includes a foldable second version panel assembly 116, sheet retaining devices in the form of elastic retaining strips 118 adapted to retain the fitted sheet 29 tautly folded around an outer surface of 119 of the panel assembly 116, and a panel assembly retaining device in the form of an elastic retaining band 120 adapted to retain the panel assembly 116 in a closed position during storage. The first version spring clips 47 may also be used if so desired to further retain the fitted sheet 29 to the panel assembly 116.

The second version panel assembly 116 comprises a plurality of rectangularly shaped panels hingedly connected together edgewise including a center panel 122 disposed between a pair of side panels 125 which form respective outer and inner surfaces 119 and 127 thereof. The panel assembly 116 has a flat opened position and a closed position wherein the inner surface 127 defines an enclosed rounded rectangular-shaped channel 128 therethrough. The center panel 122 is of a width and a length of about 8½ by 14 inches similarly to a sheet of legal size writing paper and the side panels 125 are narrower than the center panel 122 to form a center gap "CG2" therebetween to accommodate the fitted sheet 29 and the spring clips 47. The panel assembly 116 has respective side edges 129 that may be gripped by the spring clips 47 if used. The center panel 122 and side panels 125 are made of the sheet materials described above.

The side panels 125 are elastically connected to the center panel 122 using respective elastic connecting strips 130 affixed thereto using a plurality of binding loops 131 that extend through pluralities of holes 134, 137, and 138 respectively through the side panels 125, the center panel 122, and the connecting strips 130. Alternatively, the connecting strips 130 may be affixed to center panel 122 and the side panels 125 using a plurality of the rivets 63, staples (not shown), or an adhesive. The connecting strips 130 are made of rubber, elasticized cloth, or other suitable material. The binding loops 131 are made of a braided plastic material or other suitably flexible material.

The connecting strips 130 are adapted to stretch as indicated by the arrows "A" to accommodate and further retain the excess sheet material 81, the flat sheet 32, and the pillow covers 35 within the channel 128 formed by the panel assembly 116. The connecting strips 130 stretch and the retaining bands 120 retain the panel assembly 116 in a closed position as shown in FIG. 9 to retain the fitted sheet 29, the flat sheet 32, and the pillow covers 35 within the channel 128 formed by the panel assembly 116.

The elastic retaining strips 118 are affixed at opposite ends 138 thereof flat against respective of the side panels 125 using a plurality of staples 132, the rivets 63, or an adhesive. The retaining strips 118 are adapted to stretch to retain the fitted sheet 29 to respective of the side panels 125. The retaining strips 118 are made of rubber, elasticized cloth, or other suitable material.

The elastic retaining band 120 is adapted to stretch to extend about and retain the panel assembly 116 in the closed position as shown in FIG. 9 to retain the fitted sheet 29, the flat sheet 32, and the pillow covers 35 within the channel 128 of the panel assembly 116. The retaining band 120 is made of rubber, elasticized cloth, or other suitable material.

The storage device 113 is used to store the bed sheet set 26 by folding the fitted sheet 29 around the panel assembly 116 as described above. The fitted sheet 29 is secured tautly folded around the panel assembly 116 in a single layer covering the outer surface 119 using the retaining strips 118. The retaining strips 118 are used by gripping and pulling them away from respective of the side panels 125, positioning the fitted sheet 29 thereunder, and releasing the retaining strips 118 to retain the fitted sheet 29 tautly folded around the panel assembly 116. The excess sheet material 81 of the fitted sheet 29 including the elasticized corners 30 is bunched up and placed on the inner surface 127 of the panel assembly 116 along with the flat sheet 32 and the pillow covers 35 folded thereon. The panel assembly 116 is folded to the closed position to form the channel 128 containing the excess sheet material 81, the flat sheet 32, and the pillow covers 35 for storage. The retaining band 120 is stretched around the panel assembly 116 to retain the panel assembly 116 in the closed position until removed. The procedure is reversed to remove the bed sheet set 26 from the storage device 113.

Referring to FIGS. 10-13, therein is shown a third embodiment bed sheet storage device 146 for neatly compactly folding and storing the bed sheet set 26 between uses. The storage device 146 includes a foldable third version panel assembly 149, a pair of the first version spring clips 47 to retain the fitted sheet 29 tautly folded around an outer surface of 150 of the panel assembly 149, and the retaining band 120 to retain the panel assembly 149 in a closed position during storage.

The third version panel assembly 149 comprises a plurality of rectangularly shaped panels hingedly connected together edgewise including a center panel 152 disposed between a pair of side panels 155, and a pair of intermediate panels 157 hingedly connected edgewise to respective of the center panel 152 and the side panels 155 which form respective outer and inner surfaces 150 and 158 thereof. A width "W" of intermediate panels 157 may be adjusted to suit the size of the fitted sheet 29. The panel assembly 149 has a flat opened position and a closed position wherein the inner surface 158 defines an enclosed rectangular-shaped channel 159 therethrough. The center panel 152 is of a width and a length of about 8½ by 14 inches similarly to a sheet of legal size writing paper and the side panels 155 are narrower than the center panel 152 to form a center gap "CG3" therebetween to accommodate the fitted sheet 29 and the spring clips 47. The panel assembly 149 has respective side edges 160 that are gripped by the spring clips 47. The third version panel assembly 149 is of a unitary design made from a single piece of the sheet materials described above. The center panel 152, the side panels 155, and the intermediate panels 157 are pivotally connected together using respective long living hinges 161 heat-formed thereto.

The panel assembly 149 may include a pair of optional foldable corner retaining panels 164 each of semi-circular shape hingedly connected edgewise to respective of the side panels 155 adapted to retain adjacent of the elasticized corners 30 of the fitted sheet 29 to the panel assembly 149. The corner retaining panels 164 are integrally formed as part of the panel assembly 149 pivotally connected to the side panels 155 using respective short living hinges 167.

The retaining band 120 stretches about and retains the panel assembly 149 in the closed position as shown in FIG. 12 to retain the fitted sheet 29, the flat sheet 32, and the pillow covers 35 within the channel 159 of the panel assembly 149.

The storage device 146 without the retaining panels 164 is used to store the bed sheet set 26 in the same manner described above.

As best shown in FIG. 13, the storage device 146 with the retaining panels 164 is used to store the bed sheet set 26 by placing the outer surface 86 of the fitted sheet 29 in the flattened inverted position on the support surface 89. The outer surface 150 of the panel assembly 149 disposed in the opened position is placed on the inner surface 92 of the fitted sheet 29 offset between respective of the elasticized corners 30 thereof. The two elasticized corners 30 nearest the corner retaining panels 164 are moved inwardly thereover. The fitted sheet 29 is inwardly folded along respective imaginary longitudinal fold lines 172 that extend from respective end edges 173 of the panel assembly 149. If so desired, the fitted sheet 29 may be initially folded along another imaginary longitudinal fold line 175 prior thereto to accommodate larger sizes of fitted sheets 29. The corner retaining panels 164 are folded inwardly with the two elasticized corners 30 thereover. The fitted sheet 29 is then inwardly folded along respective imaginary lateral fold lines 176 that extend from respective of the side edges 160 of the panel assembly 149.

The fitted sheet 29 is secured tautly folded around the panel assembly 149 in a single layer covering the outer surface 150 using the spring clips 47 as described above except that the spring clips 47 are applied to the side edges 160 with the corner retaining panels 164 folded inwardly. The excess sheet material 81 of the fitted sheet 29 including the elasticized corners 30 is bunched up and placed on the inner surface 158 of the panel assembly 149 along with the flat sheet 32 and the pillow covers 35 folded thereon. The panel assembly 149 is folded to the closed position to form the channel 159 containing the excess sheet material 81, the flat sheet 32, and the pillow covers 35 for storage. The retaining band 120 retains the panel assembly 116 in the closed position until removed. The procedure is reversed to remove the bed sheet set 26 from the storage device 41.

Referring to FIG. 14, therein is shown a fourth embodiment bed sheet storage device 177 for neatly compactly folding and storing the bed sheet set 26 between uses. The storage device 177 includes the third version panel assembly 149 shown without the corner retaining panels 164, a pair of sheet retaining devices in the form of second version spring clips 179 adapted to retain the fitted sheet 29 tautly folded around the outer surface of 150 of the panel assembly 149, and the retaining band 120 to retain the panel assembly 149 in the closed position during storage.

The second version spring clips 179 are of a design similar to "clipboard clips" used to hold sheets of writing paper to clipboards but of a wider, lower profile design affixed to the panel assembly 149. The spring clips 179 are affixed to respective of the side panels 155 disposed in a position adjacent a one of the side edges 160 in a parallel relationship thereto so as to be disposed within the channel 159 of the panel assembly 149 in the closed position.

Each spring clip 179 includes a base 182 affixed to respective of the side panels 155 using a plurality of the rivets 63, staples (not shown), or an adhesive. The base 182 and a movable gripping arm 184 are interconnected by a torsion spring 185 adapted to bias together a plurality of gripping surfaces 186 and 187 thereof from an opened non-gripping position to a gripping position to grip and retain the fitted sheet 29 therebetween to respective of the side panels 155. The torsion spring 188 is enclosed in a spring tube 189 affixed to the base 182.

The gripping arm 184 is made of bent wire has a thumb grip 194 of upwardly curved semi-circular shape to facilitate opening of the spring clip 179. The gripping arm includes a pair of laterally dependent gripping portions 197 adapted to grip the fitted sheet 29 against the base 182. A pair of laterally dependent pivot arms 200 pivotally engage opposite ends 201 of the spring tube 185 biased by the torsion spring 185. A pair of resilient retaining tubes 203 made of rubber are fitted over the gripping portions 197 having the gripping surfaces 187 to frictionally engage the fitted sheet 29.

The storage device 177 is used to store the bed sheet set 26 by folding the fitted sheet 29 around the panel assembly 149 as described above. The fitted sheet 29 is secured tautly folded around the panel assembly 116 in a single layer covering the outer surface 150 using the spring clips 179. The spring clips 179 are used by lifting the thumb grips 194 away from the side panels 155, positioning the fitted sheet 29 between the retaining tubes 203 and the base 182, and releasing the thumb grips 194 to retain the fitted sheet 29 folded around the panel assembly 149. The spring clips 179 retain the fitted sheet 29 tautly folded around the panel assembly 149. The excess sheet material 81 of the fitted sheet 29 is bunched up, placed on the inner surface 158 of the panel assembly 149 along with the flat sheet 32 and the pillow covers 35 folded thereon, the panel assembly 149 is folded to the closed position, and the retaining band 120 retains the panel assembly 149 in the closed position until removed as described above. The procedure is reversed to remove the bed sheet set 26 from the storage device 177.

Referring to FIG. 15, therein is shown a fifth embodiment bed sheet storage device 206 for neatly compactly folding and storing the bed sheet set 26 between uses. The storage device 206 includes the third version panel assembly 149 shown without the corner retaining panels 164 and a panel assembly retaining device in the form of two pairs of mutually-attracting magnets 209 and 212 adapted to retain the panel assembly 149 in the closed position during storage.

The magnets 209 and 212 of each pair are respectively affixed to one of the side panels 155 adjacent the side edge 153 and to the center panel 152 in a mating orientation to retain the panel 149 assembly in the closed position. The magnets 209 and 212 are affixed to respective of the center panel 152 and the side panels 155 using a plurality of the rivets 63, staples (not shown), or an adhesive. The magnets 209 and 212 each extend a distance of substantially full-way across respective of the side panels 155. The magnets 209 and 212 bias the side panels 155 towards the center panel 152 to retain the panel assembly 149 in the closed position to retain the fitted sheet 29, the flat sheet 32, and the pillow covers 35 within the channel 159 of the panel assembly 149.

The storage device 206 is used to store the bed sheet set 26 by folding the fitted sheet 29 around the panel assembly 149 as described above. The fitted sheet 29 is pulled tautly folded around the panel assembly 116 in a single layer covering the outer surface 150. The excess sheet material 81 of the fitted sheet 29 is bunched up, placed on the inner surface 158 of the panel assembly 149 along with the flat sheet 32 and the pillow covers 35 folded thereon, and the panel assembly 149 is folded to the closed position. The pairs of magnets 209 and 212 retain the panel assembly 149 in the closed position and the fitted sheet 29 secured tautly folded around the panel assembly 116 until the panel assembly 149 is opened. The procedure is reversed to remove the bed sheet set 26 from the storage device 206.

Referring to FIG. 16, therein is shown a sixth embodiment bed sheet storage device 215 for neatly compactly folding and storing the bed sheet set 26 between uses. The storage device 215 includes the third version panel assembly 149 shown without the corner retaining panels 164, a pair of sheet retaining devices in the form of third version spring clips 218 adapted to retain the fitted sheet 29 tautly folded around the outer surface of 156 of the panel assembly 149, and the retaining band 120 to retain the panel assembly 149 in the closed position during storage.

The second version spring clips 218 are affixed to respective of the side panels 155 disposed in a position adjacent a one of the side edges 160 in a perpendicular relationship thereto so as to be disposed within the channel 159 of the panel assembly 149 in the closed position.

Each spring clip 218 includes a base 221 centrally affixed to respective of the side panels 155 using a plurality of the rivets 63, staples (not shown), or an adhesive. A pair of movable gripping arms 224 are integrally molded with the base 221 hingedly connected thereto at respective living hinges 227. The base 221 and the gripping arms 224 are also interconnected by respective wire springs 228 adapted to bias together respective gripping surfaces 230 and 231 thereof from an opened non-gripping position to a gripping position to grip and retain the fitted sheet 29 therebetween to respective of the side panels 155.

Each gripping arm 224 includes a rectangular body 232 having one of the gripping surfaces 231 and a semi-circular thumb grip 233 centrally disposed along the body 77 extending perpendicularly therefrom to facilitate opening of the spring clip 218.

The storage device 215 is used to store the bed sheet set 26 by folding the fitted sheet 29 around the panel assembly 149 as described above. The fitted sheet 29 is secured tautly folded around the panel assembly 116 in a single layer covering the outer surface 150 using the spring clips 218. The spring clips 218 are used by lifting the thumb grips 233 away from the base 221, positioning the fitted sheet 29 between the gripping arms 224 and the base 221, and releasing the thumb grips 233 to retain the fitted sheet 29 folded around the panel assembly 149. The spring clips 218 retain the fitted sheet 29 tautly folded around the panel assembly 149. The excess sheet material 81 of the fitted sheet 29 is bunched up, placed on the inner surface 158 of the panel assembly 149 along with the flat sheet 32 and the pillow covers 35 folded thereon, the panel assembly 149 is folded to the closed position, and the retaining band 120 retains the panel assembly 149 in the closed position until removed as described above. The procedure is reversed to remove the bed sheet set 26 from the storage device 177.

Referring to FIG. 17, therein is shown a seventh embodiment bed sheet storage device 242 for neatly compactly folding and storing the bed sheet set 26 between uses. The storage device 177 includes the third version panel assembly 149 shown without the corner retaining panels 164, sheet retaining devices in the form of a pair of fourth version spring clips 245 and a fifth version spring clip 248 adapted to retain the fitted sheet 29 tautly folded around the outer surface of 150 of the panel assembly 149, and the retaining band 120 to retain the panel assembly 149 in the closed position during storage.

The fourth and fifth version spring clips 245 and 248 are each of a design similar to "hair clips" used to hold hair in place on women's heads but of a wider, solid design that are detachable from the panel assembly 149. The spring clips 245 and 248 are operatively associated with respective of the side panels 155 disposed in a position adjacent a one of the side edges 160 in a parallel relationship thereto.

Each spring clip 245 and 248 comprises respective pairs of gripping arms 251 and 252 interconnected by respective base arms 255 and 256. The gripping arms 251 and 252 respectively extend distances of less than half-way and substantially full-way across respective of the side panels 155. The gripping arms 251 and 252 are respectively slightly convergent towards one another. The base arms 255 and 256 are each slightly longer than the side panels 155 are thick so as to function as a spring to bias together respective pairs of gripping surfaces 258 and 259 of the gripping arms 251 and 252 from respective non-flexed, opened non-gripping positions to flexed gripping positions to grip respective of the side edges 178 of the panel assembly 149 with the fitted sheet 29 therebetween to retain the fitted sheet 29 to respective of the side panels 155. The spring clips 245 and 248 are formed by bending stainless steel strip, painted carbon steel, or molded from a plastic material.

The storage device 242 is used to store the bed sheet set 26 by folding the fitted sheet 29 around the panel assembly 149 as described above. The fitted sheet 29 is secured tautly folded around the panel assembly 116 in a single layer covering the outer surface 150 using the spring clips 245 and 248. The spring clips 245 and 248 are used by spreading and positioning respective of the gripping arms 251 and 257 about the fitted sheet 29 and the side panels 155, and releasing the gripping arms 251 and 257 to retain the fitted sheet 29 folded around the panel assembly 149. The spring clips 245 and 248 retain the fitted sheet 29 tautly folded around the panel assembly 149. The spring clips 245 and 248 retain the fitted sheet 29 tautly folded around the panel assembly 149. The excess sheet material 81 of the fitted sheet 29 is bunched up, placed on the inner surface 158 of the panel assembly 149 along with the flat sheet 32 and the pillow covers 35 folded thereon, the panel assembly 149 is folded to the closed position, and the retaining band 120 retains the panel assembly 149 in the closed position until removed as described above. The procedure is reversed to remove the bed sheet set 26 from the storage device 242.

Referring to FIG. 18, therein is shown an eighth embodiment bed sheet storage device 263 for neatly compactly folding and storing the bed sheet set 26 between uses. The storage device 263 includes the third version panel assembly 149 shown without the corner retaining panels 164, sheet retaining devices in the form of four hollowed spring boxes 266 adapted to retain the fitted sheet 29 tautly folded around the outer surface of 156 of the panel assembly 149, and a pair of the retaining bands 120 to retain the panel assembly 149 in the closed position during storage.

The spring boxes 266 are of a design similar to "mop cloth clips" used to hold sheets of mopping cloth to newer mops that is affixed to the panel assembly 149. The spring boxes 266 are affixed to respective of the side panels 155 disposed at respective corners 267 of the panel assembly 149 adjacent one of the side edges 160 in a parallel relationship thereto so as to be disposed within the channel 159 of the panel assembly 149 in the closed position.

Each spring clip 266 is of a six-sided box design having a base wall 269, a peripheral wall 270 comprising four side walls 272, and a top wall 275 all of rectangular shape. The base wall 269 is affixed to respective of the side panels 155 using a plurality of the rivets 63, staples (not shown), or an adhesive. The top wall 275 has a retaining opening 278 formed by a plurality of radial slits 281 that define a plurality of resilient inwardly-directed retaining tabs 284 each of triangular shape having respective locking tips 287 adapted to grip the fitted sheet 29. The retaining tabs 284 are adapted to deflect inwardly upon application of finger pressure on the fitted sheet 29 to open the retaining opening 278 to an opened non-gripping position and rebound outwardly upon release of the finger pressure to a gripping position such that the locking tips 287 of the retaining tabs 284 pinch the fitted sheet 29 therebetween as the retaining opening 278 closes to grip and retain the fitted sheet 29 therebetween to respective of the side panels 155.

The storage device 263 is used to store the bed sheet set 26 by folding the fitted sheet 29 around the panel assembly 149 as described above. The fitted sheet 29 is secured tautly folded around the panel assembly 116 in a single layer covering the outer surface 150 using the spring boxes 266. The spring boxes 266 are used by applying the finger pressure to the fitted sheet 29 to deflect the retaining tabs 284 inwardly and open the retaining opening 278 and releasing the finger pressure so the retaining tabs 284 rebound outwardly to pinch the fitted sheet 29 therebetween as the retaining opening 278 closes to retain the fitted sheet 29 folded around the panel assembly 149. The spring boxes 266 retain the fitted sheet 29 tautly folded around the panel assembly 149. The excess sheet material 81 of the fitted sheet 29 is bunched up, placed on the inner surface 158 of the panel assembly 149 along with the flat sheet 32 and the pillow covers 35 folded thereon, the panel assembly 149 is folded to the closed position, and the retaining band 120 retains the panel assembly 149 in the closed position until removed as described above. The procedure is reversed to remove the bed sheet set 26 from the storage device 263.

Referring to FIG. 19, therein is shown a ninth embodiment bed sheet storage device 290 for neatly compactly folding and storing the bed sheet set 26 between uses. The storage device 290 includes the seventh embodiment bed sheet storage device 242 and panel assembly retaining devices in the form of seventh version spring clips 293 and an eighth version spring clip 296 adapted to retain the panel assembly 149 in the closed position during storage.

The seventh and eighth version spring clips 293 and 296 are each of a design similar to fourth and fifth version spring clips 245 and 248 that are detachable from the panel assembly 149. The spring clips 293 and 296 are operatively associated with the center panel 152 and respective of the side panels 155 disposed in a position adjacent a one of the side edges 160 in a parallel relationship thereto.

Each spring clip 293 and 296 comprises respective pairs of gripping arms 299 and 300 interconnected by respective base arms 302 and 303. The gripping arms 293 and 296 respectively extend distances of less than half-way and substantially full-way across the center panel 152 and respective of the side panels 155. The gripping arms 299 and 300 are respectively slightly convergent towards one another. The base arms 302 and 303 are each slightly longer than the panel assembly 149 in the closed position is thick so as to function as a spring to bias together respective pairs of gripping surfaces 305 and 306 of the gripping arms 293 and 296 from respective non-flexed, opened non-gripping positions to flexed gripping positions to grip and retain the panel assembly 149 in the closed position to retain the fitted sheet 29, the flat sheet 32, and the pillow covers 35 within the channel 159 of the panel assembly 149. The spring clips 245 and 248 are formed by bending stainless steel strip, painted carbon steel, or molded from a plastic material.

The storage device 290 is used to store the bed sheet set 26 by folding the fitted sheet 29 around the panel assembly 149 as described above. The fitted sheet 29 is secured tautly folded around the panel assembly 116 in a single layer covering the outer surface 150 using the spring clips 245 and 248 as described above. The excess sheet material 81 of the fitted sheet 29 is bunched up, placed on the inner surface 158 of the panel assembly 149 along with the flat sheet 32 and the pillow covers 35 folded thereon, and the panel assembly 149 is folded to the closed position. The seventh and eighth version spring clips 293 and 296 are used by spreading and positioning respective of the gripping arms 299 and 305 about the center panel 152 and side panels 155 of panel assembly 149 while in the closed position and releasing the gripping arms 299 and 305 to retain the panel assembly 149 in the closed position until removed. The procedure is reversed to remove the bed sheet set 26 from the storage device 290.

Referring to FIG. 20, therein is shown a tenth embodiment bed sheet storage device 311 for neatly compactly folding and storing the bed sheet set 26 between uses. The storage device 311 includes the third version panel assembly 149 shown without the corner retaining panels 164, a combination sheet retaining device and panel assembly retaining device in the form of a ninth version spring clip 314 adapted to retain the fitted sheet 29 tautly folded around the outer surface of 150 of the panel assembly 149 and retain the panel assembly 149 in the closed position during storage.

The ninth version spring clip 314 is detachable from the panel assembly 44, being operatively associated with respective of the side panels 155 disposed in a position adjacent both of the side edges 160 in a parallel relationship thereto.

The spring clip 314 comprises two pairs of fixed gripping arms 317 interconnected by respective base arms 320 and a middle arm 323 that interconnects the base arms 320, all integrally molded together from a plastic material such as described above. The gripping arms 317 extend a distance of substantially full-way across respective of the side panels 155. The gripping arms 317 are respectively slightly convergent towards one another. The base arms 320 are slightly longer than the side panels 155 are thick so as to function as a spring to bias together respective pairs of gripping surfaces 326 of the gripping arms 317 from respective non-flexed, opened non-gripping positions to flexed gripping positions to grip respective of the side edges 160 of the panel assembly 149 with the fitted sheet 29 therebetween to retain the fitted sheet 29 to respective of the side panels 155 and retain the panel assembly 149 in the closed position.

Each gripping arm 224 includes an elongated body 327 having one of the gripping surfaces 324 and a semi-circular thumb grip 329 centrally disposed along the body 327 extending perpendicularly therefrom to facilitate opening of the spring clip 314. The gripping surfaces 326 are each of a length sufficient to grip at least half of the side edge 59 and preferably extend substantially completely thereacross.

The storage device 311 is used to store the bed sheet set 26 by folding the fitted sheet 29 around the panel assembly 149 as described above. The fitted sheet 29 is pulled tautly folded around the panel assembly 116 in a single layer covering the outer surface 150. The excess sheet material 81 of the fitted sheet 29 is bunched up, placed on the inner surface 158 of the panel assembly 149 along with the flat sheet 32 and the pillow covers 35 folded thereon, and the panel assembly 149 is folded to the closed position. The fitted sheet 29 is secured tautly folded around the panel assembly 149 in a single layer covering the outer surface 150 using the spring clip 314. The spring clip 314 is used by lifting the thumb grips 329 away from one another, positioning the gripping surfaces 332 about the side edges 160, and releasing the thumb grips 329 to retain the fitted sheet 29 folded around the panel assembly 149. The spring clip 314 retains the fitted sheet 29 tautly folded around the panel assembly 149. The retaining clip 314 also retains the panel assembly 149 in the closed position until removed. The procedure is reversed to remove the bed sheet set 26 from the storage device 311.

A method of neatly compactly folding and storing a fitted sheet with four elasticized corners, a flat sheet, and a pair of pillow covers of a bed sheet set between uses comprises the following steps.

1) Providing a bed sheet storage device that includes a foldable panel assembly comprised of a plurality of rectangularly shaped panels hingedly connected together edgewise including a center panel disposed between a pair of side panels which form respective outer and inner surfaces thereof. The panel assembly has a flat opened position and a closed position wherein the inner surface defines an enclosed channel therethrough and at least one sheet retaining device adapted to retain the fitted sheet tautly folded around the outer surface of the panel assembly.

The panel assembly may include a pair of foldable corner retaining panels each of semi-circular shape hingedly connected edgewise to respective of the side panels. The corner retaining panels retain adjacent of the elasticized corners of the fitted sheet to the panel assembly.

The sheet retaining device is preferably: a) a resilient non-skid pad affixed to at least one of the center and side panels; b) a pair of spring clips operatively associated with respective of the side panels; c) a plurality of hollowed spring boxes affixed to respective of the side panels each having a plurality of resilient retaining tabs that deflect inwardly upon application of finger pressure on the fitted sheet; or d) a pair of elastic retaining strips affixed at opposite ends thereof flat against respective of the side panels.

The sheet retaining device preferably includes at least one panel assembly retaining device and at least one panel assembly retaining device. Each panel assembly retaining device is: a) two pairs of mutually-attracting magnets respectively affixed to one of the side panels and to the center panel in a mating orientation; b) a plurality of pairs of locking hinges affixed to respective of said center and side panels; c) a pair of spring clips operatively associated with the center panel and respective of the side panels; d) a spring clip operatively associated with respective of the side panels that also retains the fitted sheet to respective of the side panels; or e) at least one elastic retaining band adapted to stretch about the panel assembly.

2) Placing an outer surface of the fitted sheet in an unfolded inverted position on a flat horizontal support surface.

3) Placing the outer surface of the panel assembly in the opened position on an inner surface of the fitted sheet between the elasticized corners thereof. The panel assembly without the corner retaining panels is placed on the fitted sheet centered between the elasticized corners thereof. The panel assembly with the corner retaining panels is placed on the fitted sheet offset between a pair of the elasticized corners.

4) Folding the fitted sheet over the panel assembly by: a) inwardly folding the fitted sheet along respective imaginary longitudinal fold lines that extend from respective end edges of the panel assembly; and b) inwardly folding the fitted sheet along respective imaginary lateral fold lines that extend from respective side edges of the panel assembly. Folding the fitted sheet over the panel assembly having the retaining panels additionally includes: c) moving the pair of the elasticized corners inwardly over the corner retaining panels; and d) folding the corner retaining panels with the elasticized corners inwardly along the lateral fold lines that extend from where the corner retaining panels hingedly engage the side panels to retain adjacent of the elasticized corners of the fitted sheet to said panel assembly prior to a) and b).

5) Securing the fitted sheet tautly folded around the panel assembly in a single layer covering the outer surface of the panel assembly using each sheet retaining device. This may include: a) smoothing the fitted sheet against the non-skid pad; b) clipping the fitted sheet to the side panels; c) pushing the fitted sheet against the retaining tabs of the spring boxes; or d) placing the fitted sheet between the elastic strips and respective of the side panels.

6) Bunching up and placing excess sheet material on the inner surface of the panel assembly;

7) The method preferably includes the step of folding the flat sheet and the pillow covers.

8) Placing the flat sheet and the pillow covers on the excess sheet material; and 9) Folding the panel assembly to the closed position to form the channel with the excess sheet material and the folded flat sheet and pillow covers disposed within the channel for storage.

10) The method preferably includes the step of retaining the panel assembly in the closed position during storage using at least one panel assembly retaining device. This may include: a) clipping the panel assembly in the closed position; or b) clipping the fitted sheet to the side panels.

11) The method preferably includes the step of opening the panel assembly to the opened position after storage using each panel assembly retaining device. This may include: a) clipping the panel assembly in the closed position; or b) clipping the fitted sheet to the side panels.

The sheet folding and storage device and method of use thus solve the shortcomings of the prior art devices and methods and provide additional improvements by: 1) allowing easy, neat folding of fitted sheets; 2) allowing storing of the complete bed sheet set including the fitted sheet, flat sheet, and two pillow covers; 3) being of a small and lightweight design; 4) not requiring affixing to walls or other vertical surfaces and thus no resulting damage thereto; 5) enabling a single user to quickly and easily fold fitted and flat sheets with clean edges for aesthetically pleasing storage; 6) folding fitted and flat sheets used for different sized beds without necessitating adjustments; 7) not requiring any special skills or training to operate; and 8) being of a light-weight, durable, simple design.

One embodiment described herein is a bed sheet storage device for neatly compactly folding and storing a fitted sheet with four elasticized corners, a flat sheet, and a pair of pillow covers of a bed sheet set between uses, comprising: a foldable panel assembly comprised of a plurality of rectangularly shaped panels hingedly connected together edgewise including a center panel disposed between a pair of side panels which form respective outer and inner surfaces thereof, said panel assembly having a flat opened position and a closed position wherein said inner surface defines an enclosed channel therethrough; at least one sheet retaining device adapted to retain the fitted sheet tautly folded around said outer surface of said panel assembly; and wherein the storage device is used by placing said outer surface of said panel assembly in said opened position on the fitted sheet unfolded on a support surface, folding the fitted sheet over said panel assembly, securing the fitted sheet tautly folded around said panel assembly in a single layer covering said outer surface using each sheet retaining device, bunching up and placing excess sheet material on said inner surface along with the flat sheet and the pillow covers folded thereon, and folding said panel assembly to said closed position to form said channel containing the excess sheet material, the flat sheet, and the pillow covers for storage.

Further, the device described above, wherein the side panels are elastically connected to the center panel using respective elastic connecting strips affixed thereto adapted to stretch to accommodate and further retain the bunches, the flat sheet, and the pillow covers within said channel formed by said panel assembly.

Further, the device described above, wherein the panel assembly includes a pair of intermediate panels hingedly connected edgewise to respective of the center panel and the side panels.

Further, the device described above, wherein the panel assembly includes a pair of foldable corner retaining panels each of semi-circular shape hingedly connected edgewise to respective of the side panels adapted to retain adjacent of the elasticized corners of the fitted sheet to said panel assembly.

Further, the device described above, wherein the panel assembly is of a unitary design with the panels connected together using respective living hinges.

Further, the device described above, wherein the panel assembly is made of a single sheet of plastic material and the living hinges are heat-formed.

Further, the device described above, wherein the center and side panels are connected together using pairs of separate hinges affixed thereto.

Further, the device described above, wherein at least one of the sheet retaining devices comprises a resilient non-skid pad affixed to at least one of the center and side panels adapted to retain the fitted sheet in place thereagainst.

Further, the device described above, wherein the non-skid pad in made of a high friction, semi-tacky material.

Further, the device described above, wherein there are at least two of the sheet retaining devices comprising respective elastic retaining strips affixed at opposite ends thereof flat against respective of the side panels adapted to stretch to retain the fitted sheet to respective of said side panels.

Further, the device described above, wherein there are at least two of the sheet retaining devices comprising respective spring clips operatively associated with respective of the side panels each of which includes a spring adapted to bias together a pair of gripping surfaces thereof from an opened non-gripping position to a gripping position to retain the fitted sheet to respective of said side panels.

Further, the device described above, wherein each spring clip is disposed in a position adjacent a one of the side edges in a relationship thereto chosen from the group consisting of parallel and perpendicular.

Further, the device described above, wherein the spring clips each include at least one movable gripping arm having one of the gripping surfaces.

Further, the device described above, wherein each gripping arm includes a body having one of the gripping surfaces and a thumb grip centrally disposed along said body extending perpendicularly therefrom to facilitate opening of the spring clip.

Further, the device described above, wherein the spring clips are detachable from the panel assembly each comprising a pair of the gripping arms centrally interconnected by the spring to grip respective of the side edges with the fitted sheet therebetween.

Further, the device described above, wherein the gripping arms each include an elongated body having one of the gripping surfaces of a length sufficient to grip at least half of the side edge.

Further, the device described above, wherein each spring clip comprises a base affixed to respective of the side panels disposed within the channel of the panel assembly in the closed position, said base having one of the gripping surfaces and the gripping arm pivotally connected thereto interconnected by the spring to grip the fitted sheet therebetween.

Further, the device described above, wherein each spring clip includes a spring tube enclosing a torsion spring for each gripping arm affixed to the base, each gripping arm being made of bent wire having a thumb grip of upwardly curved semi-circular shape, a pair of laterally dependent gripping portions adapted to grip the fitted sheet against said base, and a pair of laterally dependent pivot arms that pivotally engage opposite ends of said spring tube being biased by said torsion spring.

Further, the device described above, wherein each spring clip includes a pair of resilient retaining tubes fitted over the gripping portions thereof adapted to frictionally engage the fitted sheet.

Further, the device described above, wherein each spring clip includes a pair of the gripping arms oppositely pivotally connected to the base biased by a pair of the springs.

Further, the device described above, wherein the gripping arms are integrally molded with the base and hingedly connected thereto at respective living hinges.

Further, the device described above, wherein there are at least two of the sheet retaining devices comprising respective spring clips operatively associated with respective of the side panels each of which includes a pair of gripping arms interconnected by a base arm, said gripping arms being slightly convergent towards one another and said base arm being slightly longer than the side panels are thick so as to function as a spring to bias together a pair of gripping surfaces thereof from an opened non-gripping position to a gripping position to retain the fitted sheet to respective of said side panels.

Further, the device described above, wherein the gripping arms extend a distance chosen from the group consisting of less than half-way and substantially full-way across respective of the side panels.

Further, the device described above, wherein there are at least two of the sheet retaining devices comprising respective hollowed spring boxes each having a base wall affixed to respective of the side panels, a peripheral wall, and a top wall having a retaining opening with a plurality of inwardly-directed retaining tabs adapted to deflect inwardly upon application of finger pressure on the fitted sheet to an opened non-gripping position and rebound outwardly upon release of said finger pressure to a gripping position to retain the fitted sheet to said side panels.

Further, the device described above, wherein the top wall has a plurality of radial slits that define the retaining tabs each of triangular shape having respective locking tips adapted to grip the fitted sheet.

Further, the device described above, wherein the spring boxes are each of a six-sided box design with the peripheral wall comprising four side walls which along with the base wall and the top wall are all of rectangular shape.

Further, the device described above, wherein there are four of the spring boxes disposed at respective corners of the panel assembly.

Further, the device described above, further comprising at least one panel assembly retaining device adapted to retain said panel assembly in the closed position during storage.

Further, the device described above, wherein each panel assembly retaining device extends a distance chosen from the group consisting of less than half-way and substantially full-way across respective of the center and side panels.

Further, the device described above, wherein the panel assembly retaining devices comprise respective pairs of separate locking hinges affixed to the center and side panels to connected them together.

Further, the device described above, wherein the locking hinges each include a pair of mounting plates affixed to respective of the panels interconnected by a pivoting locking mechanism adapted to retain the panel assembly in the closed position when said mounting plates are pivoted to a generally parallel position.

Further, the device described above, wherein the locking hinges are molded in one piece from a plastic material.

Further, the device described above, wherein there are at least two of the panel assembly retaining devices each comprising a pair of mutually-attracting magnets respectively affixed to one of the side panels adjacent the side edge and to the center panel in a mating orientation to retain said panel assembly in the closed position.

Further, the device described above, wherein there are at least two of the panel assembly retaining devices comprising respective spring clips operatively associated with the center panel and respective of the side panels each of which includes a pair of gripping arms interconnected by a base arm, said gripping arms being slightly convergent towards one another and said base arm being slightly longer than the panel assembly in the closed position is thick so as to function as a spring to bias together a pair of gripping surfaces thereof from an opened non-gripping position to gripping position to retain said panel assembly in the closed position.

Further, the device described above, wherein there the panel assembly retaining device comprises a spring clip operatively associated with respective of the side panels which includes two oppositely facing pairs of gripping arms interconnected by respective base arms and a middle arm that interconnects the base arms, said gripping arms being slightly convergent towards one another and said base arm being slightly longer than the side panels are thick so as to function as a spring to bias together a pair of gripping surfaces thereof from an opened non-gripping position to a gripping position to retain the fitted sheet to respective of said side panels and retain said panel assembly in the closed position.

Further, the device described above, wherein each panel assembly retaining device comprises an elastic retaining band adapted to stretch about and retain the panel assembly in the closed position.

Another embodiment described herein is a bed sheet storage device for neatly compactly folding and storing a fitted sheet with four elasticized corners, a flat sheet, and a pair of pillow covers of a bed sheet set between uses, comprising: a foldable panel assembly comprised of a plurality of rectangularly shaped panels hingedly connected together edgewise including a center panel disposed between a pair of side panels which form respective outer and inner surfaces thereof, said panel assembly having a flat opened position and a closed position wherein said inner surface defines an enclosed channel therethrough; at least one of a sheet retaining device adapted to retain the fitted sheet tautly folded around said outer surface of said panel assembly and a panel assembly retaining device adapted to retain said panel assembly in said closed position during storage; and wherein the storage device is used by placing said outer surface of said panel assembly in said opened position on the fitted sheet unfolded on a support surface, folding the fitted sheet over said panel assembly, securing the fitted sheet tautly folded around said panel assembly in a single layer covering said outer surface using each sheet retaining device, bunching up and placing excess sheet material on said inner surface along with the flat sheet and the pillow covers folded thereon, and folding said panel assembly to said closed position to form said channel containing the excess sheet material, the flat sheet, and the pillow covers for storage.

Further, the device described above, wherein each spring box is of a six-sided box design with the peripheral wall comprising four side walls which along with the base wall and the top wall are all of rectangular shape, said top wall having a plurality of radial slits that define the retaining tabs each of triangular shape having respective locking tips adapted to grip the fitted sheet.

Further, the device described above, wherein each panel assembly retaining device is chosen from the group consisting of: 1) two pairs of mutually-attracting magnets respectively affixed to one of the side panels adjacent the side edge and to the center panel in a mating orientation to retain the panel assembly in the closed position; 2) a plurality of pairs of separate locking hinges each including a pair of mounting plates affixed to respective of said center and side panels interconnected by a pivoting locking mechanism to connected them together adapted to retain said panel assembly in said closed position when said mounting plates are pivoted to a generally parallel position; 3) at least a pair of spring clips operatively associated with said center panel and respective of said side panels each of which includes a pair of gripping arms interconnected by a base arm, said gripping arms being slightly convergent towards one another and said base arm being slightly longer than said panel assembly in the closed position is thick so as to function as a spring to bias together a pair of gripping surfaces thereof from an opened non-gripping position to a gripping position to retain said panel assembly in the closed position; 4) a spring clip operatively associated with respective of said side panels which includes two oppositely facing pairs of gripping arms interconnected by respective base arms and a middle arm that interconnects the base arms, said gripping arms being slightly convergent towards one another and said base arm being slightly longer than the side panels are thick so as to function as a spring to bias together a pair of gripping surfaces thereof from an opened non-gripping position to a gripping position to retain the fitted sheet to respective of said side panels and retain said panel assembly in the closed position; and 5) at least one elastic retaining band adapted to stretch about and retain said panel assembly in the closed position.

Another embodiment described herein is a method of neatly compactly folding and storing a fitted sheet with four elasticized corners, a flat sheet, and a pair of pillow covers of a bed sheet set between uses, comprising the steps of: providing a bed sheet storage device that includes a foldable panel assembly comprised of a plurality of rectangularly shaped panels hingedly connected together edgewise including a center panel disposed between a pair of side panels which form respective outer and inner surfaces thereof, the panel assembly having a flat opened position and a closed position wherein the inner surface defines an enclosed channel therethrough and at least one sheet retaining device adapted to retain the fitted sheet tautly folded around the outer surface of the panel assembly; placing an outer surface of the fitted sheet in an unfolded inverted position on a flat horizontal support surface;

placing the outer surface of the panel assembly in the opened position on an inner surface of the fitted sheet between the elasticized corners thereof; folding the fitted sheet over the panel assembly; securing the fitted sheet tautly folded around the panel assembly in a single layer covering the outer surface of the panel assembly using each sheet retaining device; bunching up and placing excess sheet material on the inner surface of the panel assembly; placing the flat sheet and the pillow covers on the excess sheet material; and folding the panel assembly to the closed position to form the channel with the excess sheet material, the flat sheet, and the pillow covers disposed within the channel for storage.

The method described above, further comprising the step of opening the panel assembly to the opened position after storage using each panel assembly retaining device.

The method described above, wherein: 1) the panel assembly of the bed sheet storage device provided includes a pair of foldable corner retaining panels each of semi-circular shape hingedly connected edgewise to respective of the side panels to retain adjacent of the elasticized corners of the fitted sheet to said panel assembly; 2) the panel assembly is placed on the fitted sheet offset between a pair of the elasticized corners; and 3) the step of folding the fitted sheet over the panel assembly comprises moving the pair of the elasticized corners inwardly over the corner retaining panels, folding the corner retaining panels with the elasticized corners inwardly along respective imaginary lateral fold lines that extend from where the corner retaining panels hingedly engage the side panels, and inwardly folding the fitted sheet along respective imaginary longitudinal fold lines that extend from respective end edges of the panel assembly.

The method described above, further comprising the steps of: folding the flat sheet and the pillow covers prior to placing on the excess sheet material; retaining the panel assembly in the closed position during storage using at least one panel assembly retaining device; opening the panel assembly to the opened position after storage using each panel assembly retaining device; and wherein; A) the sheet retaining device of the bed sheet storage device provided is chosen from the group consisting of: 1) a resilient non-skid pad affixed to at least one of the center and side panels; 2) a pair of spring clips operatively associated with respective of the side panels; 3) a plurality of hollowed spring boxes affixed to respective of the side panels each having a plurality of resilient retaining tabs that deflect inwardly upon application of finger pressure on the fitted sheet; and 4) a pair of elastic retaining strips affixed at opposite ends thereof flat against respective of the side panels; B) the step of securing the fitted sheet around the panel assembly includes respective of: a) smoothing the fitted sheet against the non-skid pad; b) clipping the fitted sheet to the side panels; c) pushing the fitted sheet against the retaining tabs; and d) placing the fitted sheet between the elastic strips and respective of the side panels; C) the bed sheet storage device provided includes at least one of the panel assembly retaining devices each chosen from the group consisting of: 1) two pairs of mutually-attracting magnets respectively affixed to one of the side panels and to the center panel in a mating orientation; 2) a plurality of pairs of locking hinges affixed to respective of said center and side panels; 3) a pair of spring clips operatively associated with the center panel and respective of the side panels; 4) a spring clip operatively associated with respective of the side panels that also retains the fitted sheet to respective of the side panels; and 5) at least one elastic retaining band adapted to stretch about the panel assembly; D) the step of retaining the panel assembly in the closed position for the pair and single spring clips includes respective of: a) clipping the panel assembly in the closed position; and b) clipping the fitted sheet to the side panels; and E) wherein the step of folding the fitted sheet over the panel assembly comprises inwardly folding the fitted sheet along respective imaginary longitudinal fold lines that extend from respective end edges of the panel assembly and inwardly folding the fitted sheet along respective imaginary lateral fold lines that extend from respective side edges of the panel assembly.

Further, the method described above, wherein the panel assembly of the bed sheet storage device provided is placed on the fitted sheet centered between the elasticized corners thereof.

Further, the method described above, wherein: 1) the panel assembly of the bed sheet storage device provided includes a pair of foldable corner retaining panels each of semi-circular shape hingedly connected edgewise to respective of the side panels at the lateral fold lines to retain adjacent of the elasticized corners of the fitted sheet to said panel assembly; 2) the panel assembly is placed on the fitted sheet offset between a pair of the elasticized corners; and 3) the step of folding the fitted sheet over the panel assembly includes moving the pair of the elasticized corners inwardly over the corner retaining panels and folding the corner retaining panels with the elasticized corners inwardly along the lateral fold lines.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A bed sheet storage device for folding and storing a fitted sheet with four elasticized corners, a flat sheet, and a pair of pillow covers of a bed sheet set to create an enclosed package, comprising:

a fitted sheet with four elasticized corners, a flat sheet, and a pair of pillow covers,/ a foldable panel assembly comprised of a plurality of rectangularly shaped panels connected together including a center panel disposed between a pair of side panels, said panel assembly movable between a flat opened position and a closed position in which the panel assembly creates an enclosed channel;

at least one fastening device located on one of the side panels for retaining the fitted sheet around said panel assembly; and wherein the storage device is placed within an unfolded condition of the fitted sheet when the storage device is in the opened position, the side panels are folded toward the center panel along with the fitted sheet into the closed position to form the enclosed channel, and the at least one fastening device fastens the fitted sheet to one of the side panels.

2. The bed sheet storage device according to claim 1, wherein the side panels are narrower than the center panel and a center gap is formed between the side panels in the closed position.

3. The bed sheet storage device according to claim 1, wherein the at least one fastening device comprises a pair of spring clips.

4. The bed sheet storage device according to claim 1, wherein the side panels are affixed to the center panel using materials chosen from the group consisting of an adhesive, binding loops, rivets, and staples.

5. The bed sheet storage device according to claim 1, wherein the center panel and the side panels are made of a sheet material chosen from the group consisting of corrugated plastic, solid plastic, and vinyl covered cardboard.

6. The bed sheet storage device according to claim 1, wherein the at least one fastening device extends along the side panel for a distance chosen from the group consisting of less than half-way and substantially full-way across the side panel.

7. The bed sheet storage device of claim 1 wherein the plurality of rectangularly shaped panels are connected together by at least one hinge.

8. The bed sheet storage device of claim 1 wherein the foldable panel assembly includes a pair of intermediate panels hingedly connected to respective of said center panel and said side panels.

9. The bed sheet storage device of claim 1 wherein the side panels are elastically connected to the center panel using respective elastic strips affixed thereto adapted to stretch to accommodate and further retain fitted sheet, the flat sheet, and the pillow covers within the channel formed by the panel assembly.

10. The bed sheet storage device of claim 1 further comprising a panel assembly retaining device configured to retain said panel assembly in said closed position during storage.

11. The bed sheet storage device of claim 10 wherein the panel retaining device includes a pair of mutually attracting magnets.

12. A bed sheet storage device for folding and storing a fitted sheet with four elasticized corners, a flat sheet, and a pair of pillow covers of a bed sheet set to create an enclosed package, comprising:

a fitted sheet with four elasticized corners, a flat sheet, and a pair of pillow covers;

a foldable panel assembly comprised of a plurality of rectangularly shaped panels connected together including a center panel disposed between a pair of side panels, said panel assembly movable between a flat opened position and a closed position in which the panel assembly creates an enclosed channel for storing excess material of the fitted sheet, the flat sheet, and the pair of pillow covers;

a fastener adapted to retain the fitted sheet around said panel assembly; and a panel assembly retaining device adapted to retain said panel assembly in said closed position during storage.

13. The bed sheet storage device according to claim 12, wherein the foldable panel assembly includes a pair of intermediate panels hingedly connected to respective of said center panel and said side panels.

14. The bed sheet storage device according to claim 12, wherein the fastener includes a non-skid pad affixed to at least one of said center and side panels adapted to retain the fitted sheet in place.

15. The bed sheet storage device of claim 12 wherein the side panels are elastically connected to the center panel using respective elastic strips affixed thereto adapted to stretch to accommodate and further retain fitted sheet, the flat sheet, and the pillow covers within the channel formed by the panel assembly.

16. The bed sheet storage device of claim 12 wherein the panel assembly is of a unitary design made of a single sheet of plastic material with the panels connected together using respective living hinges that are heat-formed.

17. The bed sheet storage device of claim 12 wherein the side panels are narrower than the center panel and a center gap is formed between the side panels in the closed position.

18. The bed sheet storage device of claim 12 wherein the fastening device comprises a pair of spring clips operatively associated with each of the side panels, each spring clip disposed adjacent a side edge of each side panel.

19. The bed sheet storage device of claim 12, wherein the center panel and the side panels are made of one of corrugated plastic, solid plastic, or vinyl covered cardboard.

* * * * *